United States Patent [19]

Kasuga

[11] 4,319,533

[45] Mar. 16, 1982

[54] AUTOMATIC SEWING MACHINE

[75] Inventor: Noboru Kasuga, Hachioji, Japan

[73] Assignee: Janome Sewing Machine Co., Ltd., Tokyo, Japan

[21] Appl. No.: 95,088

[22] Filed: Nov. 16, 1979

Related U.S. Application Data

[63] Continuation of Ser. No. 813,491, Jul. 7, 1977, abandoned.

[30] Foreign Application Priority Data

Jul. 9, 1976 [JP] Japan ..... 51-81593

[51] Int. Cl.[3] ..... D05B 3/02

[52] U.S. Cl. ..... 112/158 E

[58] Field of Search ..... 112/158 E, 158 A, 158 D, 112/158 R

[56] References Cited

U.S. PATENT DOCUMENTS 3,874,312 4/1975 Cook et al. ..... 112/158 E X 4,084,523 4/1978 Kasuga ..... 112/158 A

*Primary Examiner*—Peter P. Nerbun

*Attorney, Agent, or Firm*—Michael J. Striker

[57] ABSTRACT

An automatic pattern stitch sewing machine is disclosed in which groups of cams act to engage and disengage cam followers from a plurality of pattern cams and including change-over switches opened and closed in a predetermined sequence when one of the groups of cams reaches a position selecting position.

7 Claims, 34 Drawing Figures

FIG. 14-A
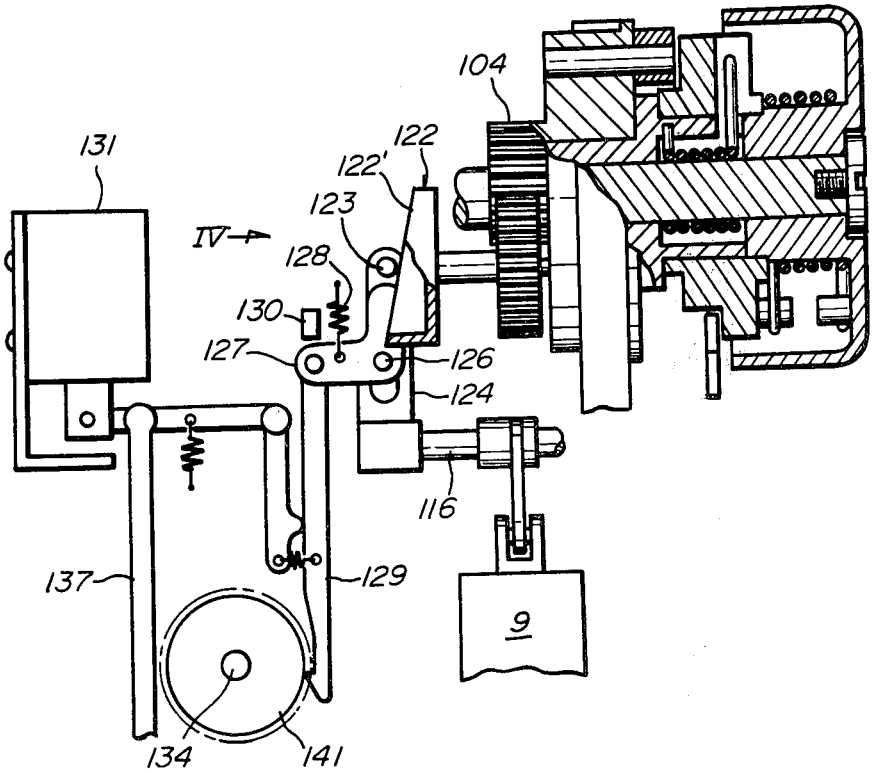

FIG_14-B
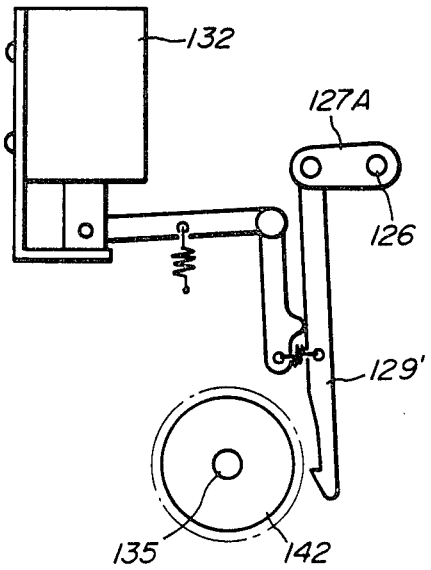
FIG_14-C
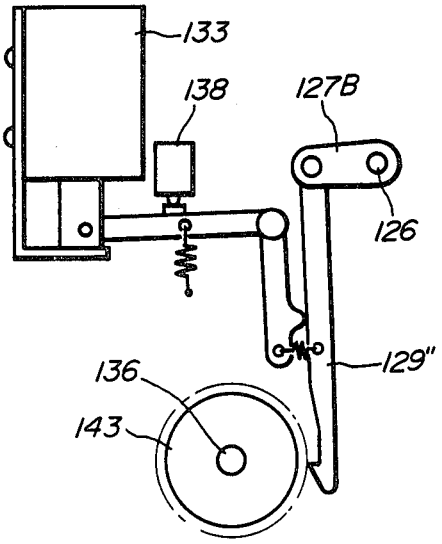

FIG. 18-A
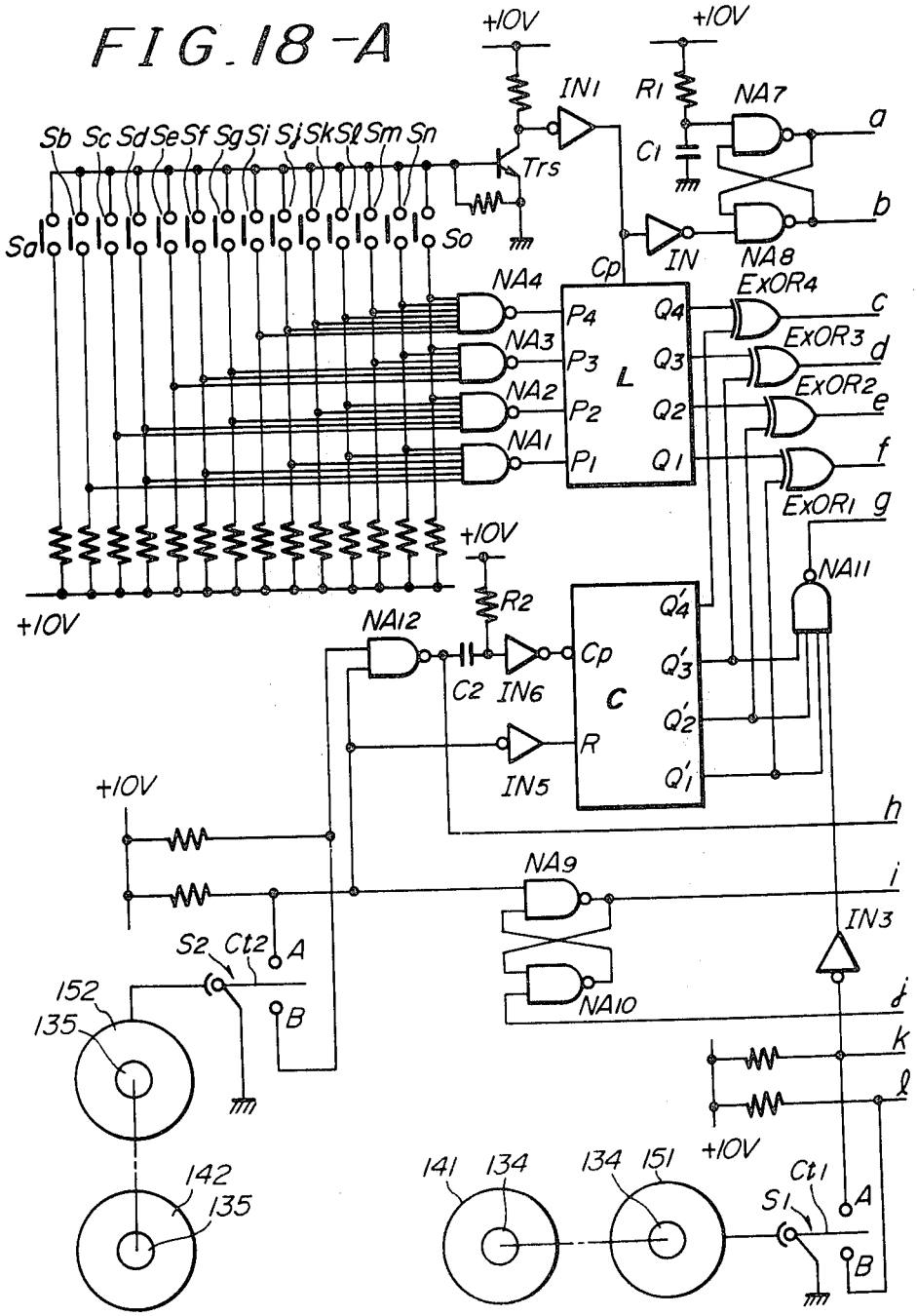

FIG. 18-B
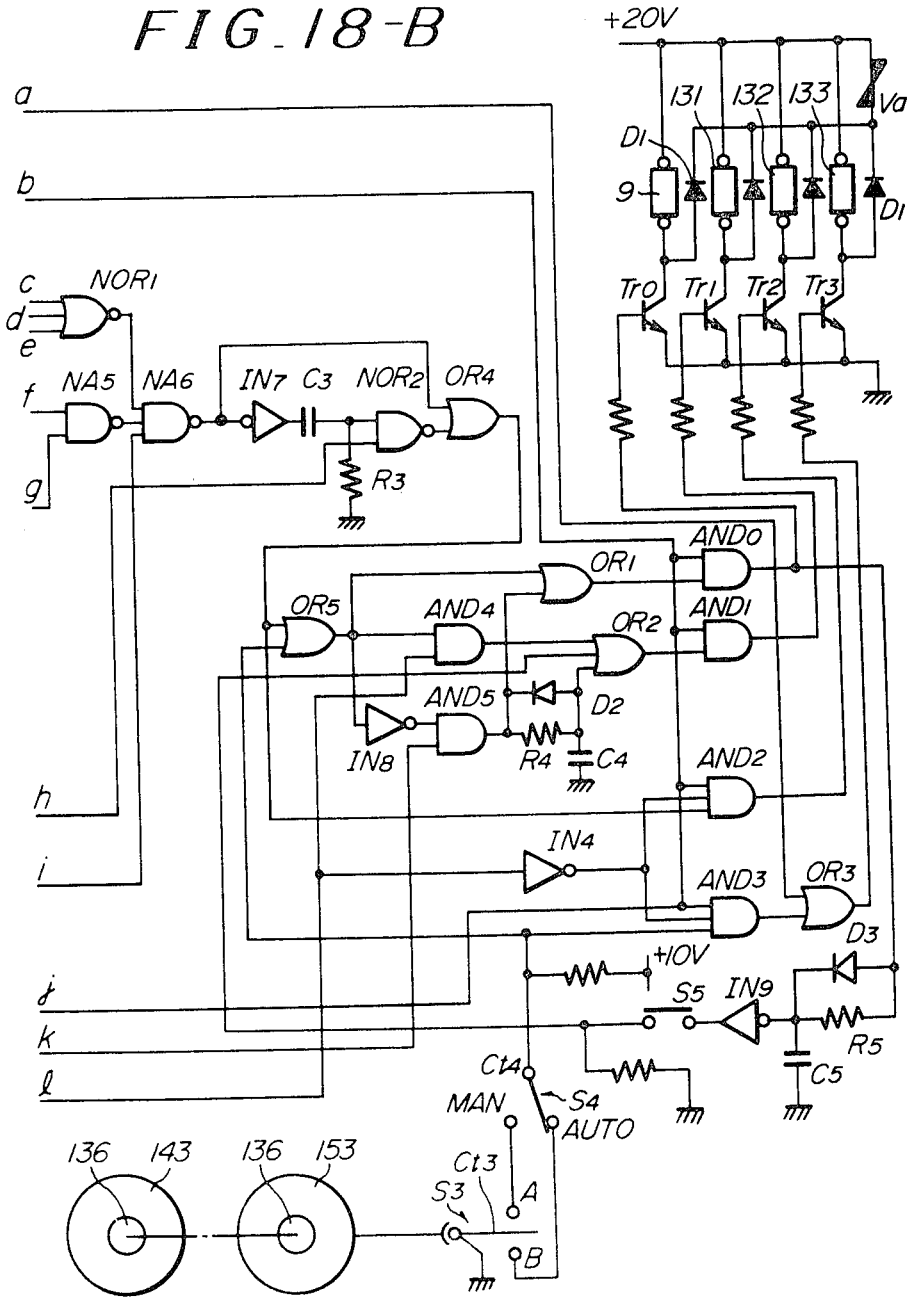

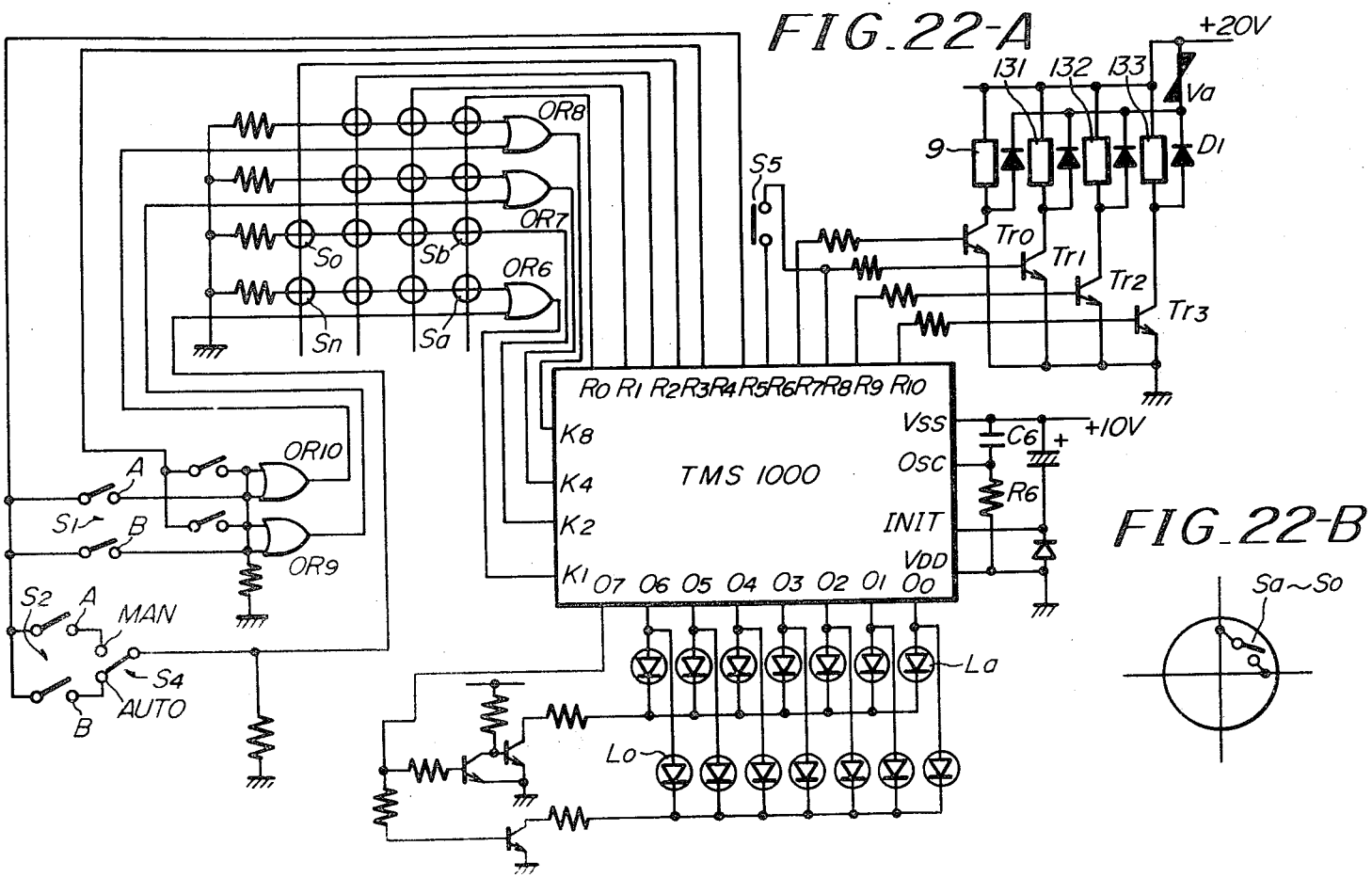
FIG. 22-A
FIG. 22-B
+20V
Va
D1
133
132
131
9
Tr0
Tr1
Tr2
Tr3
+10V
C6
R6
TMS 1000
VSS
OSC
INIT
VDD
O0
O1
O2
O3
O4
O5
O6
O7
K1
K2
K4
K8
R0 R1 R2 R3 R4 R5 R6 R7 R8 R9 R10
S5
OR6
OR7
OR8
OR9
OR10
Sa
Sb
So
Sn
Sa~So
La
Lo
A
B
S1
S2
MAN
AUTO
S4

FIG. 23-A
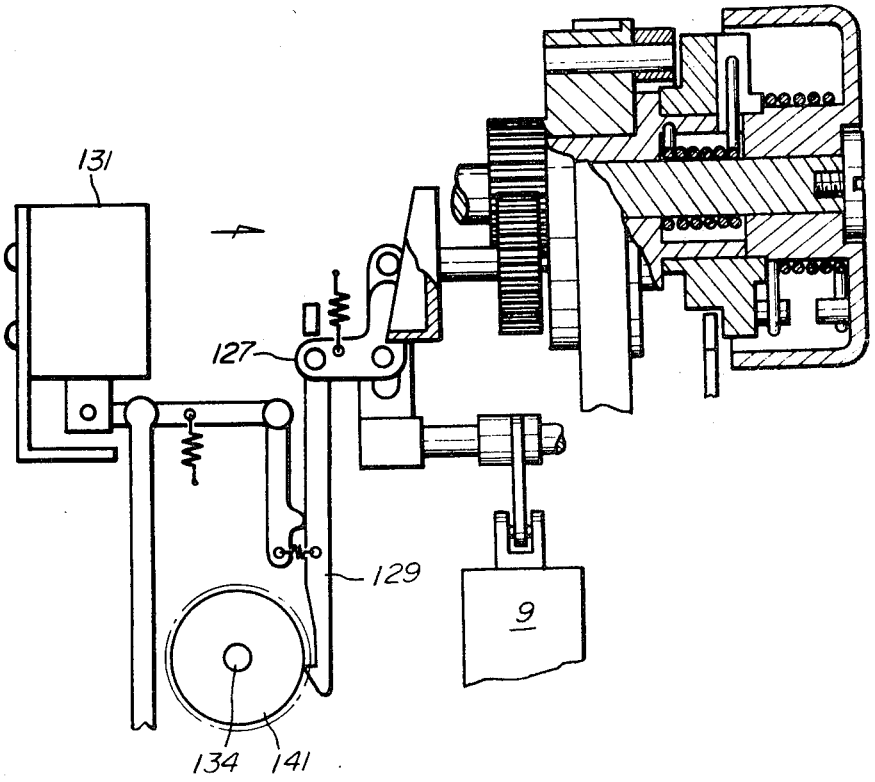

FIG_23-B
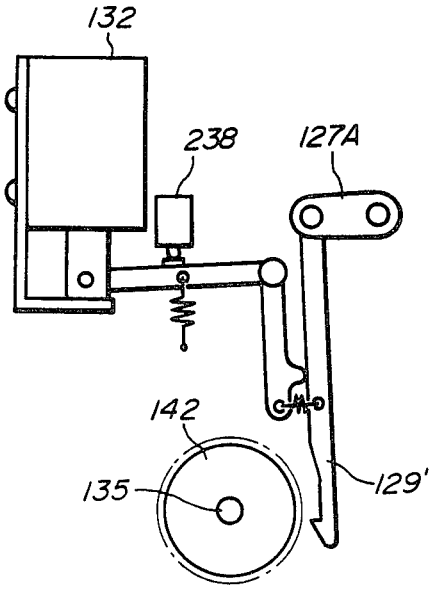
FIG_23-C
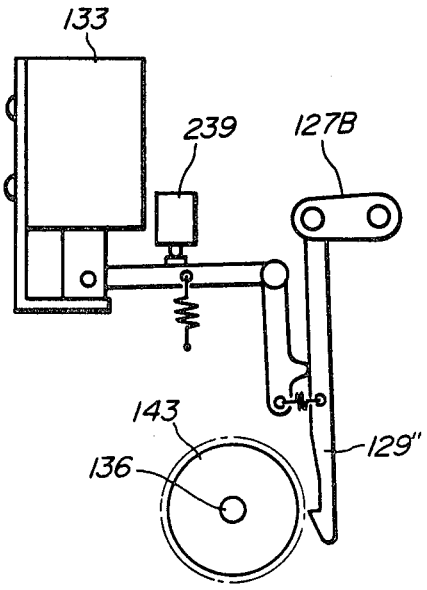

FIG. 24-A
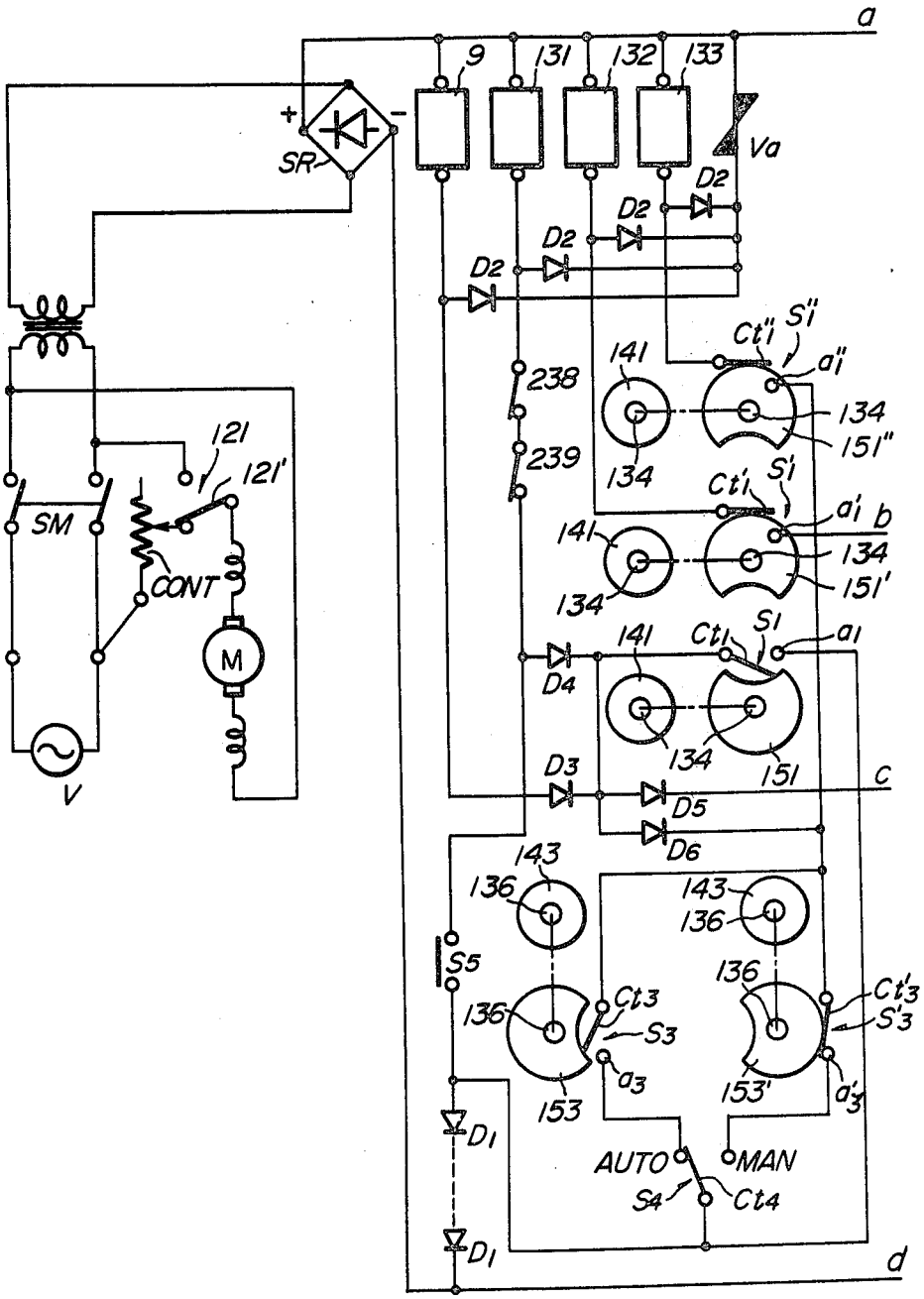

FIG_24-B
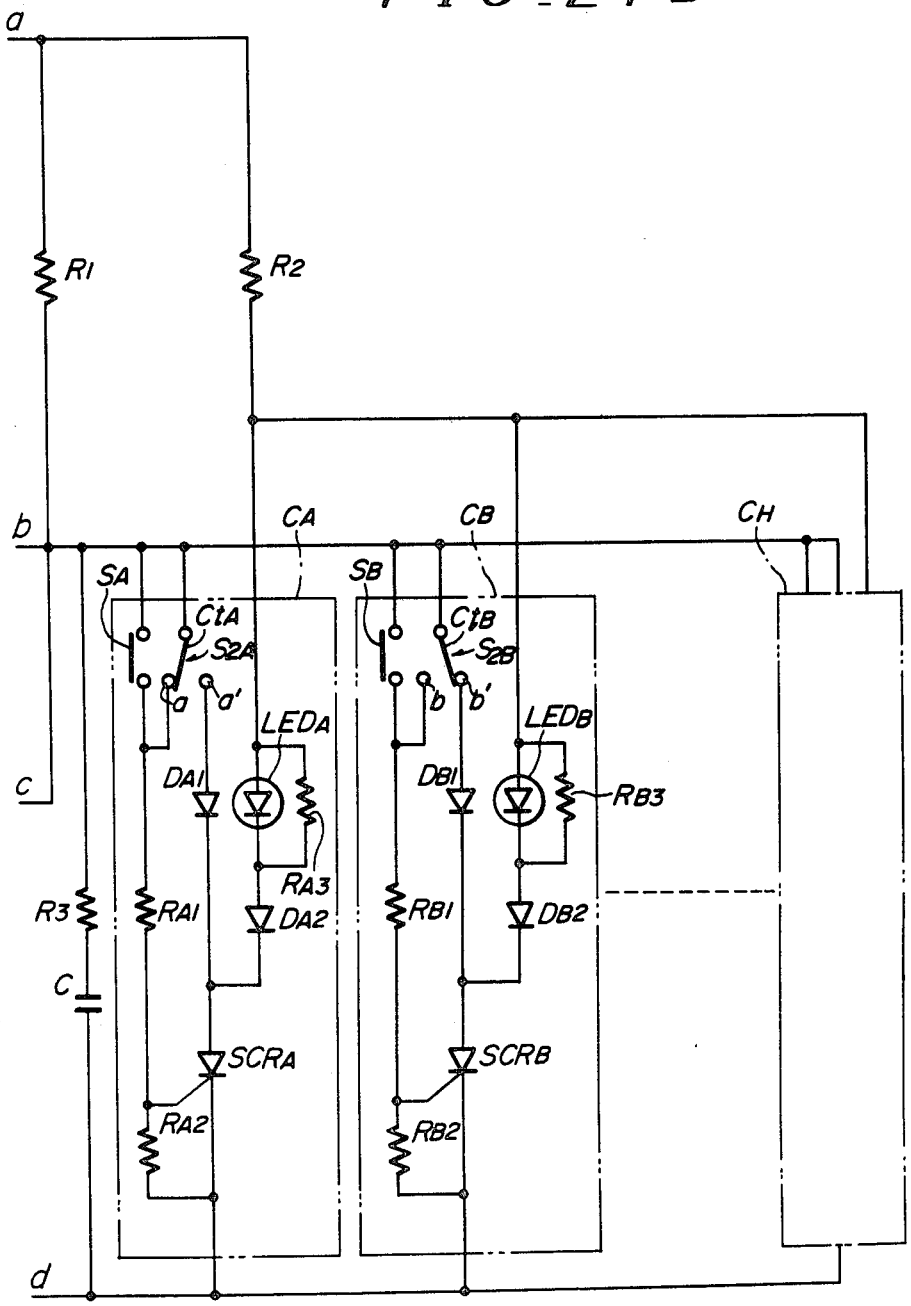

AUTOMATIC SEWING MACHINE

This is a continuation of application Ser. No. 813,491, filed July 7, 1977, now abandoned.

BRIEF DESCRIPTION OF THE INVENTION

This invention relates to an automatic sewing machine which stitches various stitch patterns including zigzag stitches, super zigzag stitches, buttonhole stitches and intermittent stitches. A single buton, selected with an operator's slight finger pressure, causes the sewing machine to automatically and rapidly adjust various elements in preparation for the desired stitches by means of a power means. Such adjustable elements and parameters are: feed amplitude, lateral amplitude, lateral amplitude pattern, feeding amount, feed dog height, needle hole shape in the needle plate, presser foot pressure, needle position, stitching speed, and if necessary, thread tension, and an automatic stopping machanism.

In the prior art, when stitch patterns are changed over from one to another, it has been necessary to manually adjust many control knobs of the sewing machine in their proper order. Since such adjustments are complex, errors are often made, and considerable efforts are required when there are many kinds of stitch patterns available. In general, many shortcomings are involved in the prior art.

The present invention has been devised to overcome the shortcomings of the prior art.

It is a primary object of the invention to cause the adjustable elements of the sewing machine to be set for stitching the selected pattern by one operation of a single control button.

It is a second object of the invention to automatically determine the proper set positions of the adjustable elements automatically by one manual operation of the single button.

It is a third object of the invention to hold the main shaft of the sewing machine free from rotation during selection of the patterns by the button operation.

Many other features and operating advantages of the invention will be apparent from the following description of embodiments according to the invention.

BRIEF DESCRIPTION OF THE DRAWINGS

FIG. 14 shows main parts of the sewing machine, in outline, showing a second embodiment of the invention;

FIG. 18 is a control circuit of the embodiment in FIG. 23;

FIG. 22-A is a controlling circuit of a third embodiment of the invention;

FIG. 22-B is a switching part of the control circuit;

FIG. 23 shows main parts of a fourth embodiment of this invention in outline;

FIG. 24 shows a control circuit for the fourth embodiment of this invention;

DETAILED DESCRIPTION OF THE INVENTION

Figure 1:
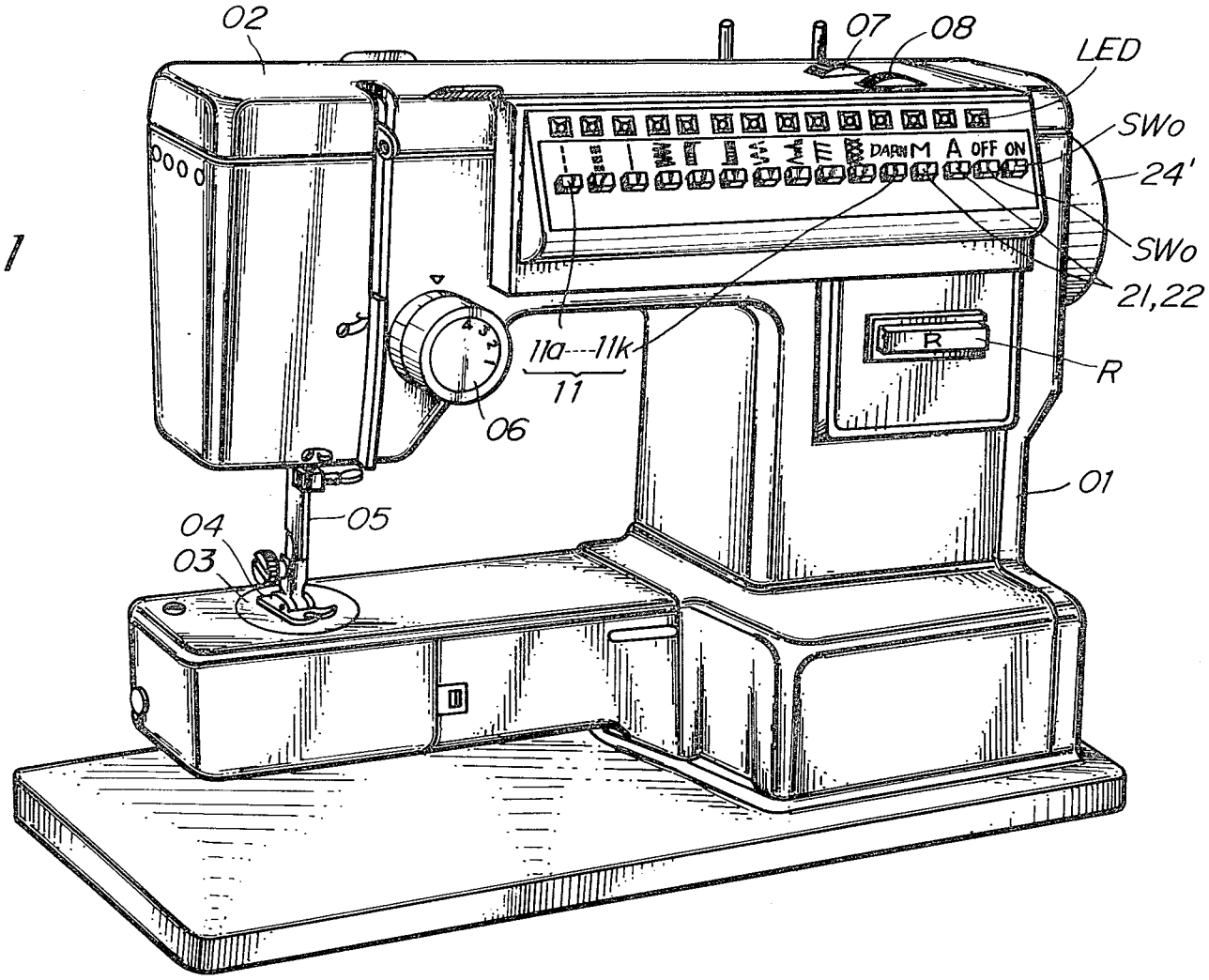
FIG. 1 shows the outer appearance of an automatic sewing machine according to the present invention.
Figure 2:
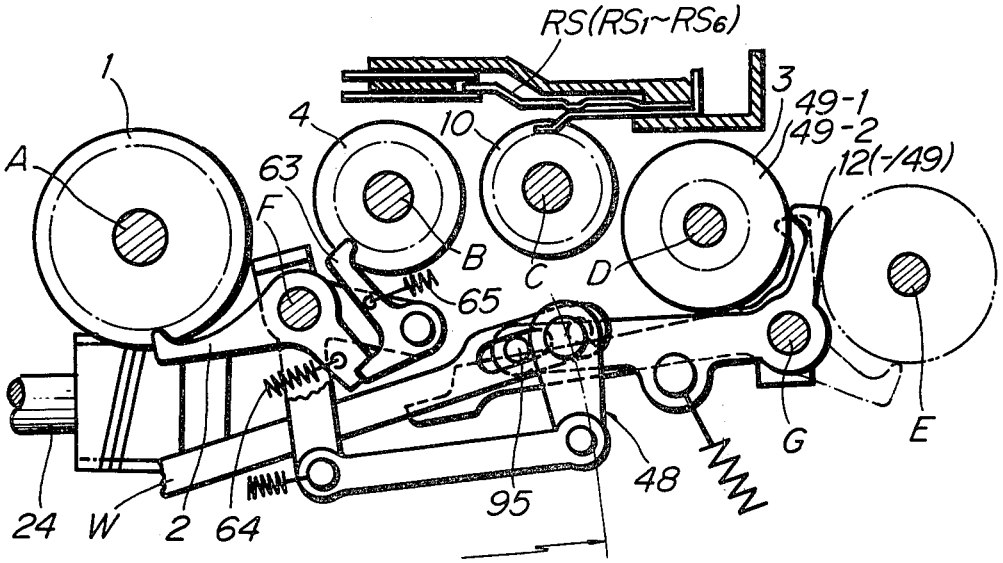
FIGS. 2 and 3 are front elevation views showing arrangements of cams of the invention.
Figure 3:
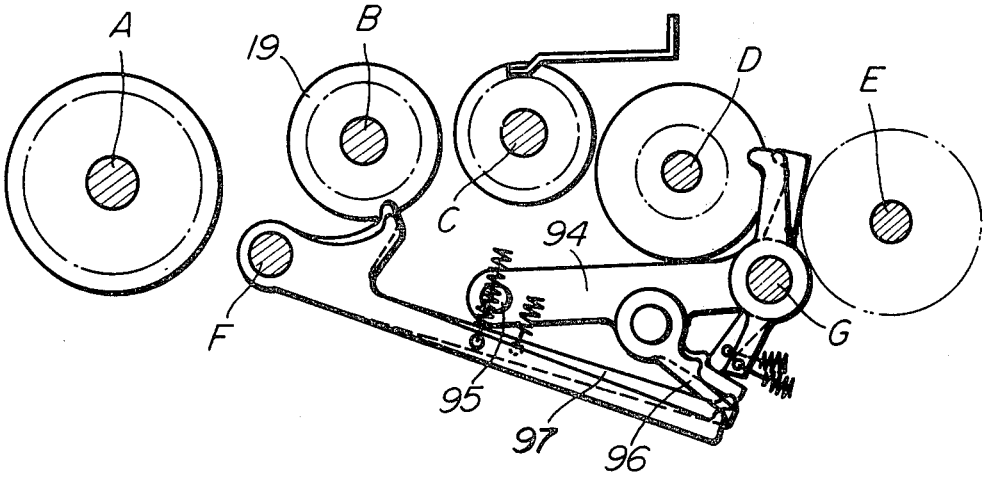
Figure 4:
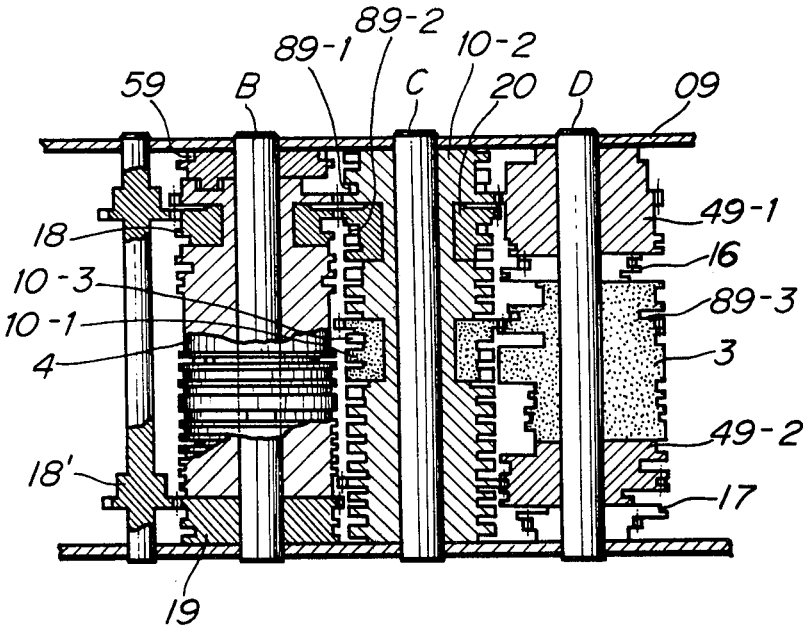
FIG. 4 is a plan view, partially in section, of the embodiments in FIGS. 2 and 3.
Figure 11:
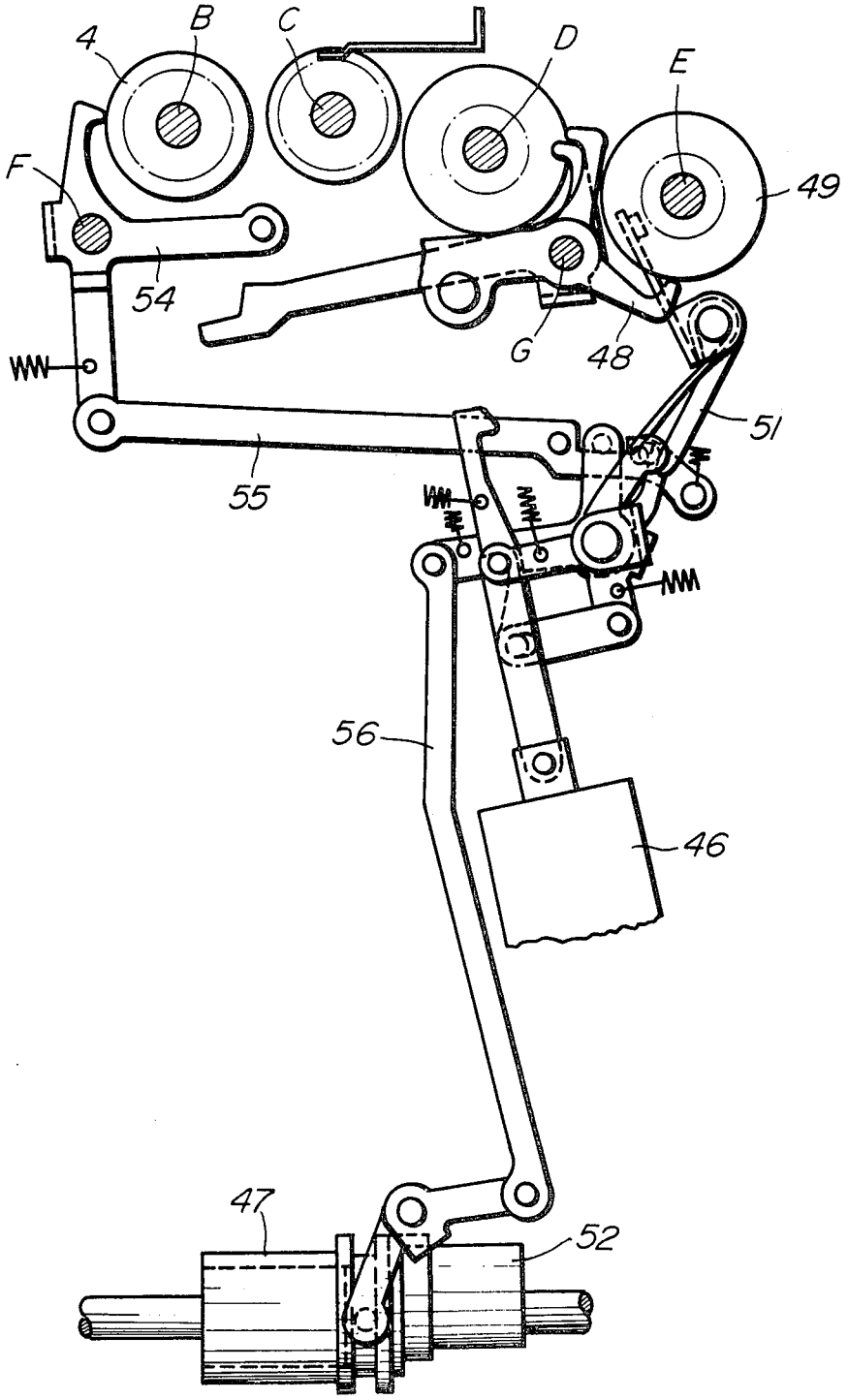
FIG. 11 is a button hole finish stitching mechanism.
Figure 12:
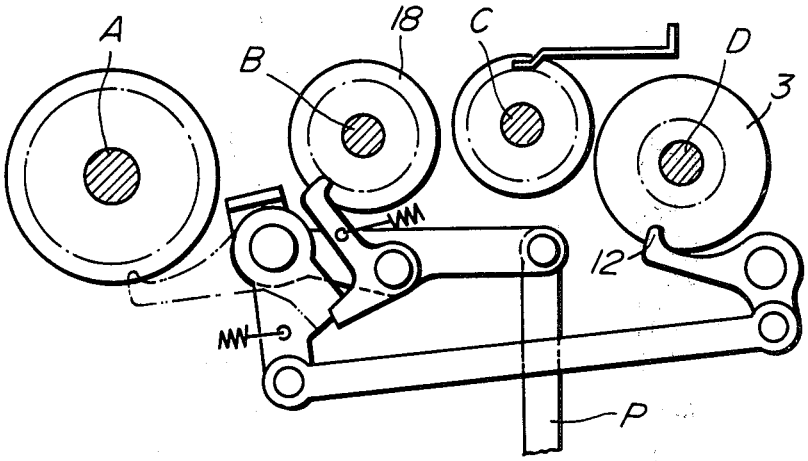
FIG. 12 is an explanatory view of a manual-automatic exchanging device for the feed control.
Figure 13:
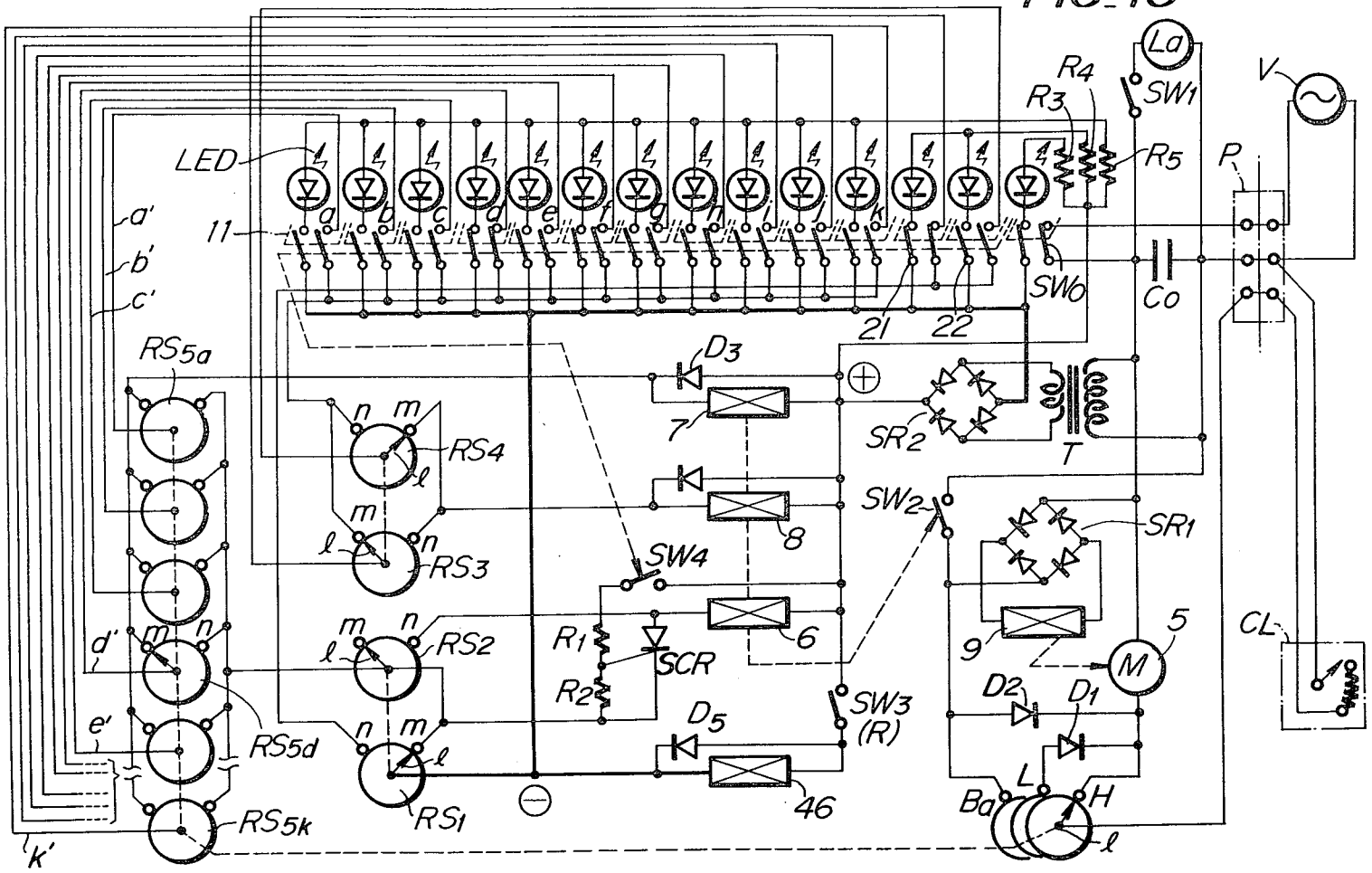
FIG. 13 is an electric circuit for the first embodiment of this invention.

In FIG. 1, reference numeral 01 denotes the head of the sewing machine, 02 denotes a top plate, 03 denotes a needle plate which enables the separator to alter the shape of a needle dropping hole, 04 denotes a presser foot secured to the lower end of a presser bar 05, 06 denotes a thread tension control, and 24' denotes a flywheel provided at the right side end of a main shaft 24 (see FIG. 7). 11 collectively shows a series of electric pushbutton switches 11*a* through 11*k* for selecting patterns, and each of these switch buttons, as is shown in FIG. 13, controls two circuits. When any one of the switches is slightly pushed with a finger, the other switches are automatically turned OFF by means of a suitable mechanical mechanism, and simultaneously the two circuits are operated. One of the circuits is operative only while the button is pressed, while the other circuit continues to operate until another button is pushed to release the previously pushed button. These electric switches 11*a* through 11*k* may have associated semiconductor switching elements, each such element being arranged to close one circuit in response to manual operation of a selected one of the push buttons. R indicates a reverse button for reversing the feeding drive of the sewing machine. When this button R is pushed, a switch $SW_3$ in FIG. 13 is closed. Switches 21 and 22 are respectively, automatic and manual switches. The automatic switch causes all the stitch adjusting elements (the feeding device, the needle bar swinging device, the needle hole, the presser device, and the stitching speed) to be automatically adjusted in accordance with the patterns selected by the buttons 11*a* to 11*k*. The manual switch enables the machine operator to manually adjust the needle swing adjusting device (48 in FIG. 2) and the feed adjusting device (52 in FIG. 11) by manually operating a feed control dial 07 and an amplitude control dial 08 provided on the top plate and thus vary an automatically adjusted stitch, such as the zigzag stitch. $SW_0$ is a switch for turning the machine on and off. LED collectively shows lamps indicating the operation of the push buttons. In FIGS. 2–4, reference characters A through G denote shafts which are provided between two frame plates 09, which are fixedly provided on both sides of the main shaft 24. These plates are located above the main shaft and rotatably support many cams and their corresponding followers. A numeral 1 indicates a set of pattern generating cams driven at a reduced speed by the main shaft 24 via a reduction gear. 2 indicates a plurality of followers, each rotatably mounted on the shaft F and engaging corresponding cams 1. W indicates a rod which transmits swinging movements of the followers 2 to a needle bar via a zigzag amplitude adjusting device 48. P (in FIG. 12) indicates a rod which transmits the swinging movements of the followers 2 to a feed control device 52 (in FIG. 11). 63 indicates a plurality of locking members which are rotatably mounted on a shaft arranged in parallel with the shaft F. The locking members will each engage, at one end 9, corresponding selecting cams 4 on the shaft B, and at the other end can engage the corresponding followers 2. When end 9 of locking member 63 engages the recess of the corresponding selecting cam 4 during rotation of the cam 4, the other end of the locking member is turned to lock the corresponding followers 2, so that the followers 2 can transmit the swinging movements from the pattern generating cams 1 to the needle bar swing adjusting device 48 or to the feed adjusting device (52 in FIG. 11). The followers 2 may be replaced by a single follower which is displacable along the shaft F to select a desired one of the pattern cams 1. The pattern cams 1 and the followers 2 may be replaced by a solid state or magnetic tape pattern memory and actuators connected to the pattern memory, the actuators taking out a selected pattern from the memory as a mechanical output through magnetic solenoids.

RS represents a group of switches which are operated by the rotation of switching cams 10 or switching cams 20 in FIG. 4. In the embodiment shown in FIG. 4 and FIG. 13, there are illustrated 18 combinations of the switches and cams, though FIG. 13 shows rotary switches for the sake of convenience, and shows contact elements 1 of the switches being operated by the switching cams. Switches $RS_1$ and $RS_2$ are operated by the switching cams 10-1 and 10-2, switches $RS_3$ and $RS_4$ are operated by cam 20, and switches $RS_{5a}$ through $RS_{5k}$ and $RS_6$, $RS_7$, and $RS_8$ are operated by cam 10-2.

Figure 6:
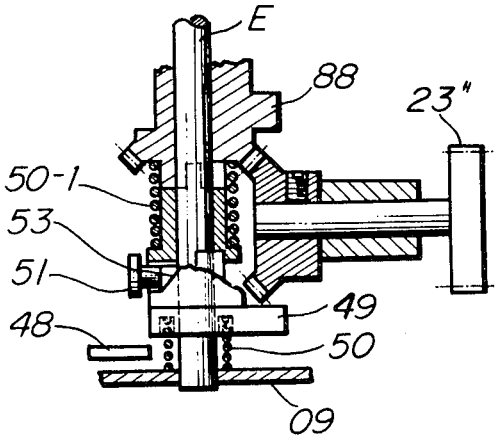
FIG. 6 is a plan view, partially in cross section, of a cam portion of the invention.
Figure 5:
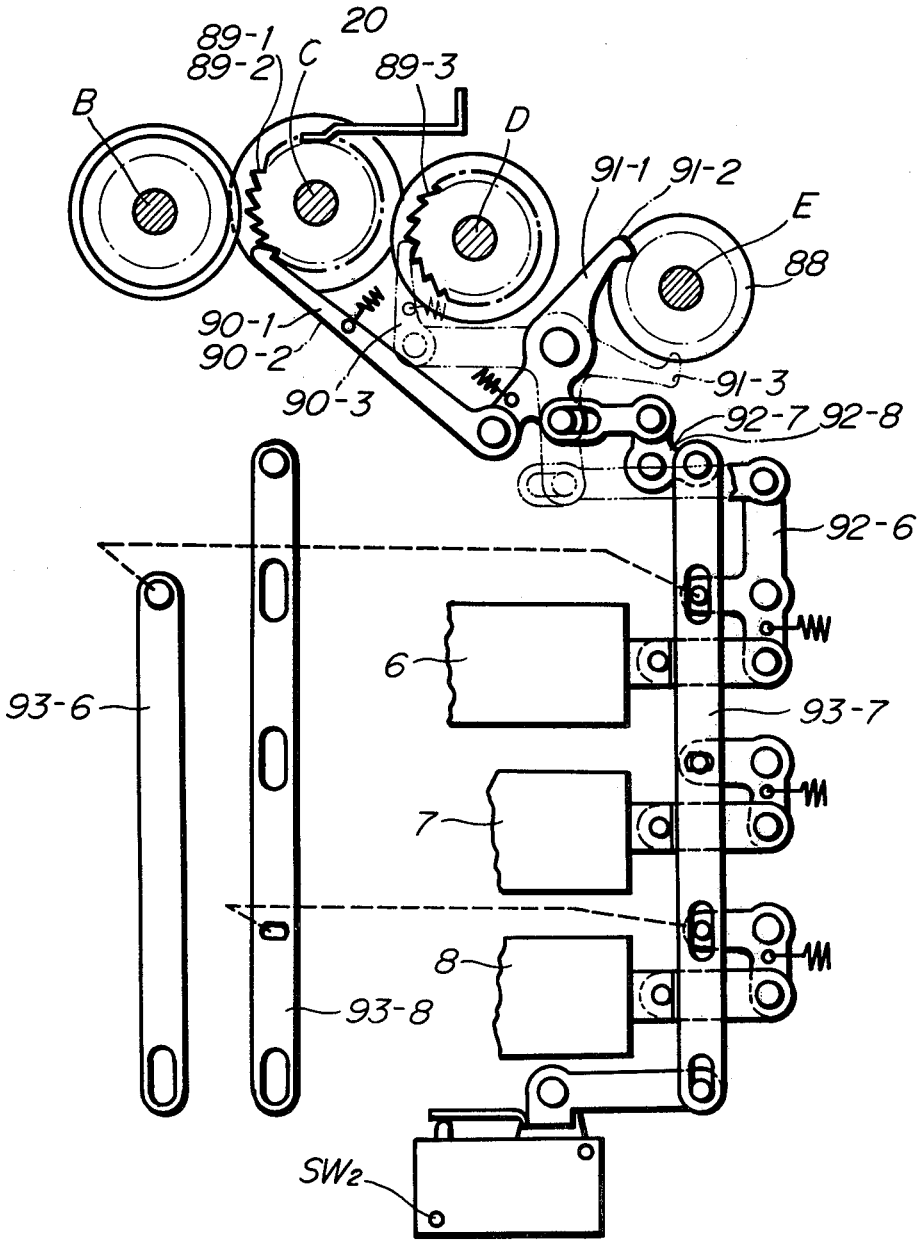
FIG. 5 is a front elevational view of a cam driving machanism of the invention.
Figure 7:
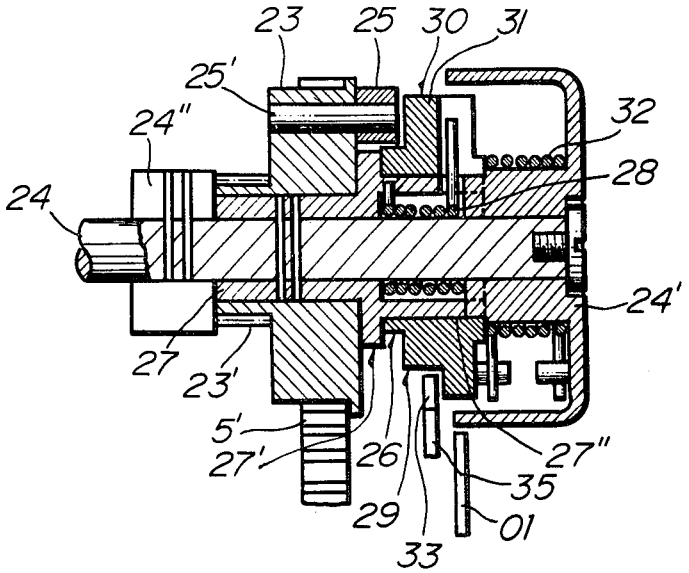
FIG. 7 is a front elevational view, partially in cross section, of a main shaft driving mechanism.
Figure 8:
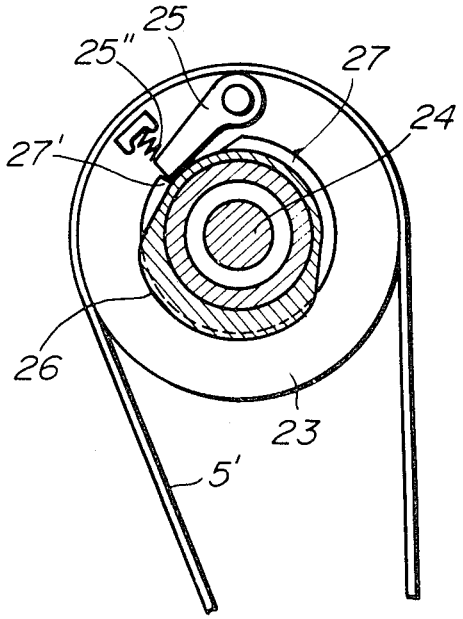
FIGS. 8 and 10 are side elevational views of a main shaft engaging and disengaging mechanism of the invention.

In FIG. 5, the numerals 6, 7, and 8 indicate solenoids. $SW_2$ indicates a microswitch which is closed if any one of the solenoids is energized. 88 indicates a rotation cams which is provided on a shaft E and rotated together with a motor 5. The cam 88 is, as is shown in FIG. 6 and FIG. 7, provided coaxially with a bevel gear meshing with a bevel gear coaxial with a flat gear 23'' which is in mesh with a flat gear portion 23' of a belt wheel 23 that is connected to motor 5 via a belt 5'.

When the solenoid 8 is energized, a follower 91-2 is brought into engagement with one of the cams 88 through a rod 93-8 and a link 92-8. As the result, a ratchet pawl 90-2 is continuously reciprocated to intermittently rotate a ratchet wheel 89-2. Therefore, the switching cams (20 in FIG. 4) which are integral with the ratchet wheel, are rotated counterclockwise on the shaft C.

The switching cam 20 and mechanical switching cams 18 and 19 are connected to each other by means of gears 18' so that these cams may be rotated together. When the solenoid 6 is energized, a ratchet wheel 81-3 on a shaft D is intermittently rotated, releasing cams 3 and the switching cams 10-1 and 10-3 are rotated stepwise with the same timing. When the solenoid 7 is energized, follower 91-1, pawl 90-1 and ratchet wheel 89-1 become effective, and the switching cams 10-2 on the shaft C, the pattern selecting cams 4 on the shaft B and limiting cams 49-1 on the shaft D are rotated with the same timing. 16 and 17 denote cams for controlling the needle swinging device and the feeding device via manual operation of the dials 07, 08 on the top plate of the sewing machine.

In FIGS. 7 to 10, 24'' is a timing belt pulley fixed on the main shaft 24, and connects a lower shaft (not shown) of the sewing machine and the main shaft 24 by means of a timing belt (not shown). 27 indicates a bushing secured to the main shaft 24 and having a flange 27' with an engaging notch 27''. 23 indicates a belt wheel rotatably mounted on the bushing 27, and driven in direction RO by the machine motor 5. 25 indicates a clutch pawl for rotating the main shaft, rotatably mounted on a shaft 25' which is provided on the belt wheel 23 parallel to the main shaft 24. The clutch pawl 25 is biased by a spring 25'' so that its end point contacts the flange 27' of the bushing 27.

31 indicates a stopper cam body mounted on the bushing 27 and limited relative to the bushing 27 via a buffer spring 28. Adjacent to the flange portion 27' of the bushing 27, the cam body 31 is formed with a cam edge 26 for disengaging the clutch pawl 25 from the notch 27'' of the bushing 27 against the action of the spring 25'' when the stopper cam body 31 is rotated relative to the bushing 27. The cam body 31 is also formed with a portion 29 of small diameter and an inclined part 30 which are engaged by an end of a stopper 33.

Figure 9:
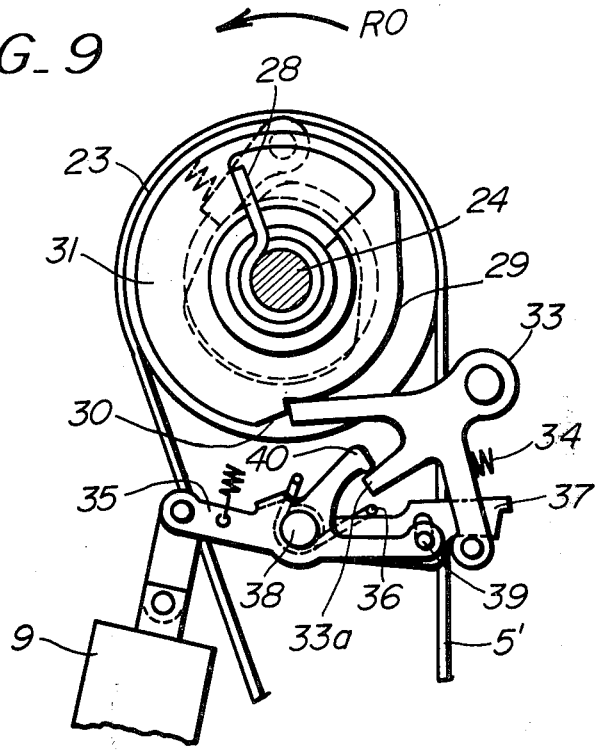
Figure 10:
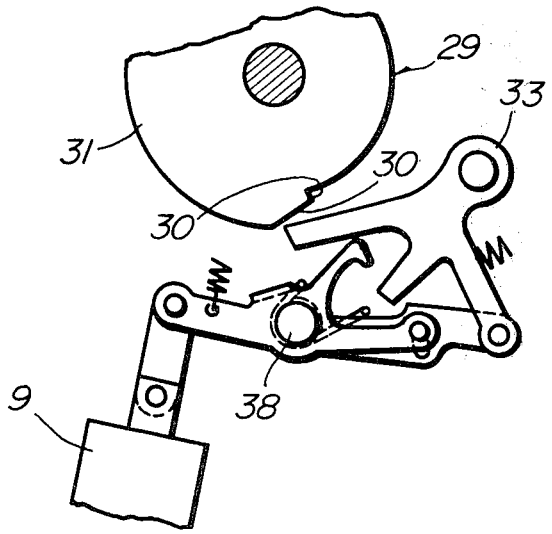

32 denotes a weak return spring which provides mutual rotation between a flywheel 24' secured to the main shaft 24 and the stopper cam body 31. 9 indicates a solenoid. 35 denotes a stopper actuating arm pivoted at 38 on the machine housing together with a holding arm 37. Stopper 33 is pivoted on the machine housing and has its actuating end biased towards the center of the stopper cam 31 by means of a biasing spring 34. The holding arm 37 is, as shown in FIG. 9 and 10, rotatable within a limited range defined by a pin 39 on the actuating arm with respect to the actuating arm 35, and is biased clockwise by a spring 36. If solenoid 9 is energized together with the motor 5 when the stopper 33 is held as shown in FIG. 10 while the sewing machine is operating, the holding end of the holding arm 37 is rotated upwardly around the pivot 38, and the stopper 33 is moved, (as shown in FIG. 9) to a position stopping the sewing machine. When the controller (CL, FIG. 13) is released from stepping, the motor is deenergized and stopped, solenoid 9 is simultaneously returned, and an end 40 of the arm 35 contacts a center arm **33*a* of the stopper 33 (as shown in FIG. 9) to shift the stopper end of the stopper 33 out of the small diameter portion 29 of the stopper cam 31 and to move it to the position where it engages the inclined cam edge 30' of the stopper cam 31 which is rotated by the spring 28 relative to the main shaft 24**.

Therefore, if a weak driving force still remains in the motor 5 at that time, the motor cannot rotate the main shaft and completely stops, and the sewing machine is automatically stopped in place. Subsequently, when the controller CL in FIG. 18 is stepped to rotate the motor 5 with a strong driving force (but a low speed) and solenoid 9 is simultaneously energized, the stopper end of the stopper 33 is released from the cam edge 30' to a position where it engages the inclined part 30, and the stopper end of the stopper 33 is then shifted out of the stopper cam body 31 by the inclined part 30 of the cam body 31 as is shown in FIG. 10.

A further reference will be made to an electric circuit shown in FIG. 13. M indicates the machine motor 5, one end of which is connected to a power source V via a switch $SW_0$, and the other end of which is connected to the power source V via a controller CL when a later mentioned speed changing rotary switch $RS_6$ is positioned at a high speed side H, and is connected to the power source V via a diode $D_1$ and the controller CL when switch $RS_6$ is positioned at a low speed side L, and further is connected to the power source V via a diode $D_2$ and the controller CL when said switch $RS_6$ is at an intermittent stitching side Ba. p indicates a connector. La indicates a lamp for the sewing machine. $SW_1$ indicates a switch for the lamp. $C_0$ indicates an anti-interference capacitor. Solenoid 9, as mentioned above, moves the stopper 33 between its effective and ineffective positions. The solenoid 9 is connected to a full wave rectifying circuit $RS_1$ which is connected to the power source V via intermittent stitching side Ba of the rotary switch $RS_6$. In this embodiment, the solenoid, (when it is supplied with more than a predetermined voltage,) is operated to release the clutch pawl 25 to its ineffective position, so that the main shaft 24 and the controller CL are pressed to a position between the initial stepping position and the maximum stepping position by the force of the motor 5. 6 represents a solenoid for rotating the releasing cam 3 (shown in FIGS. 2, 4, and 5.) This solenoid 6 is connected at one end to a full wave rectifying circuit $SR_2$ and is connected at the other end, via a thyristor SCR, to a contact m of the rotary switch $RS_1$ and is further connected to the contact 1 of a rotary switch $RS_2$.

The contacts 1, 1 of switches $RS_1$ and $RS_2$ are switched over, closed or opened by rotation of the cams 10-1, and 10-3 (in FIG. 4) which are rotated with the releasing cams 3. The other end of solenoid 6 is connected to the contact n of the releasing side of the switch $RS_2$. 7 represents a solenoid associated with the selecting cams 4 and the cams 10-2. One end of solenoid 7 is connected to the full wave rectifying circuit $SR_2$ and the other end is connected to the contacts m of the selecting rotary switches $RS_5a$ to $RS_5k$ which are in turn switched over by the cams 10-2, which cams are each associated with one of the respective eleven pattern selecting switches 11*a* to 11*k*. The contacts n of the switches $RS_5a$ to $RS_5k$ are connected to the contact 1 of the switch $RS_2$. The switches $RS_5a$ to $RS_5k$ are operated in synchronism with the rotation of the selecting cams 4. 8 represents a solenoid for the automatic-manual switching cam 20. One end of solenoid 8 is connected to the full wave rectifying circuit $SR_2$ and the other end is connected to the terminal n at the solenoid side of a first rotary switch $RS_3$ and to the terminal m at the solenoid side of a second rotary switch $RS_4$. The contacts 1, 1 of these switches $RS_3$, and $RS_4$ are operated by rotation of the switching cam 20. A contact 1 of the speed changing rotary switch $RS_6$ is operated by the rotation of the selecting cam 4. $SW_2$ is a switch which is closed when any one of the solenoids 6, 7, or 8 is energized. One end of the switch $SW_2$ is connected to a terminal Ba of the intermittent stitching side of the rotary switch $RS_6$ and the other end of the switch is connected to the power source V. When the switch $SW_2$ is closed, the machine motor 5 is driven at a low speed via the diode $D_2$ independently of the controller CL. A low AC voltage is supplied to the full wave rectifying circuit $SR_2$ via voltage reducing transformer T. 46 denotes a solenoid for adjusting the feed direction changing device 47 in FIG. 11, and is connected to the full wave rectifying circuit $SR_2$. $SW_3$ is a switch which energizes the solenoid 46 while the reverse button R is pushed. The diodes $D_3$, $D_4$, and $D_5$ connected in parallel with the solenoids, 7, 8 and 46 energize solenoids for a predetermined period of time, even if the solenoids are disconnected from the power source, in order to prevent the switch $SW_2$ from being temporarily opened when the rotary switches operate. This also protects the contacts of the rotary switches on disconnection. Numerals 11*a* and 11*k* indicate the pattern selecting switches, each connected at one end to the terminal m at the switch side of the first rotary switch $RS_3$ and to the terminal n at the switch side of the second rotary switch $RS_4$. The pattern selecting switches are each connected at their other ends to the respective contact elements 1 of the rotary selecting switches $RS_5a$ to $RS_5k$ via connecting leads a' to k'. 21 represents a switch for permitting manual setting of the feeding device and the needle swinging device. 22 indicates a switch for providing an automatic setting of these devices. The switches 21 and 22 are each connected at one end to the contact n at the releasing side of the releasing rotary switch $RS_1$, and are connected at the other end to contact elements 1 of the first and second rotary switches $RS_3$ and $RS_4$ respectively. $SW_4$ is a switch which is closed only when any one of the switches 11*a* to 11*k*, 21 or 22 is closed. However the switch $SW_4$ is instantly opened. When the switch $SW_4$ is closed, the thyristor SCR is triggered via a resistor $R_1$. $R_2$ denotes a resistor for protecting the gate of the thyristor SCR.

LED collectively indicates light-emitting diodes to indicate that the switches 11*a* to 11*k*, 21 and 22 and $SW_0$ have been individually operated and closed. $R_3$, $R_4$ and $R_5$ indicate protective resistors for the light-emitting diodes.

In this electric circuit, when the power source switch $Sw_0$, the manual setting switch 21 and any one of the pattern selecting switches 11*a* to 11*k* (for example the switch 11*d* in FIG. 18) are closed, the switch $SW_4$ is temporarily closed and the thyristor SCR becomes conductive. Since the contact 1 of the rotary switch $RS_1$ in association with releasing cams 3 has been moved to position m after the preceding operation of the circuit, the releasing solenoid 6 is energized. Thus, the switch $SW_2$ (in association with the solenoid 6) is closed to energize the releasing solenoid 9 to disconnect the motor 5 and the main shaft 24. When the switch $SW_2$ is closed, the motor 5 is rotated at a low speed via the diode $D_2$, independently of the controller CL. While the solenoid 6 is energized, the releasing cams 3 are intermittently rotated to shift the contacts 1 of the switch $RS_1$ from contact m to contact n. Thus, the solenoid 6 is deenergized. Concurrently, the contact element 1 of the rotary switch $RS_2$ is shifted to contact n from contact m. Since contact 1 of the switch $RS_1$ has been shifted to contact n, the selecting solenoid 7 is enerized via the cam selecting rotary switch $RS_5d$ (which is associated with the selecting cams 4 and corresponds to the pattern selecting switch 11*d*) the switch 11*d*, the switch $RS_3$ (associated with the manual-automatic switching cam 20), the manual setting switch 21, and the switch $RS_1$.

Thus, the pattern generating cams 1 corresponding to the pattern selecting switch 11*d* are selected by solenoid 7, and contact 1 of the switch $RS_5d$ is simultaneously shifted from contact m to contact n and deenergizes the solenoid 7. At this time, solenoid 6 is again energized via the switches $RS_2$, $RS_5d$, 11*d*, $RS_3$, 21, and $RS_1$ to cause the releasing cams 3 to release, and contact 1 of switch $RS_1$ is concurrently shifted from contact m to contact n and contact 1 of switch $RS_2$ is shifted from contact m to contact n. Then the switch $RS_1$ is once again in the position it was in prior to operation of the pattern selecting switch 11*d*, but since the thyristor SCR has been deenergized, the solenoid 6 is not energized. Therefore, the selection of the pattern cams 1 is completed. In FIG. 2, the disengagement of the followers 63 from the corresponding followers 2 and the selective engagement of the followers 63 with the followers 2 is completed. The switch $SW_2$ then is opened, the solenoid 9 is deenergized, and the motor 5 is stopped.

When the automatic setting switch 22 is closed as is shown in FIG. 18, the manual setting switch 21 is opened and the thyristor SCR becomes conductive. When contact 1 of switch $RS_1$ in association with the releasing cams 3 is shifted to contact n, the solenoid 8 is energized via the switch $RS_4$, and the automatic setting switch 22, the switch $RS_1$, and the manual-automatic switching cam 20 come into play. The contacts 1, 1 of the respective switches $RS_3$ and $RS_4$ are then shifted from the respective contacts m, m to contacts n, n respectively, and the solenoid y is then energized via the switch $RS_4$ to select the pattern cams 1. This is different from the case in which the manual setting switch 21 is closed. Since the switching cam 20 comes into play, the cloth feeding amount and/or the needle swinging amplitude and the other adjustable parts of the sewing machine will be automatically adjusted in accordance with the selected pattern cams 1. However, when the manual setting switch 21 is closed, such adjustments are manually set by the manual dials 07 and 08 with respect to the feeding amount and the needle swinging amplitude in accordance with the selected pattern cams 1.

When a new switch other than the pattern selecting switch 11*d* is pushed, the switch 11*d* is thereby opened, and new pattern cams 1 corresponding to the pattern selecting switch 11 are selected in the same manner as mentioned above. The pattern cams 1 which have been previously selected are rendered inoperative by the selecting cams 4 which are rotated during selection of the new pattern cams, and simultaneously contact 1 of the switch $RS_5d$ is returned to contact m.

When the pattern selecting switch 11*c* is closed, intermittent stitching is selected and the contact 1 of speed changing switch $RS_6$ is moved to contact Ba, and the sewing machine is driven at a low speed via the controller CL, the switch $RS_6$ and the diode $D_2$. Solenoid 9 is energized to operate the stopper 33 and stops the main shaft 24 of the sewing machine at a predetermined angular position corresponding to the upper dead point of the needle. When releasing the controller, the solenoid 9 is deenergized to make the stopper 33 inoperative, but the stopper 33 engages the inclined part 30 of the stopper cam 31 at the stopping position of the main shaft 24. Therefore, with the subsequent stepping of the controller, the stopper 33 is displaced out of the rotation path of the stopper cam 31, and the motor 5 is connected with the main shaft 24 to drive the shaft until the main shaft makes one complete rotation.

Figure 15:
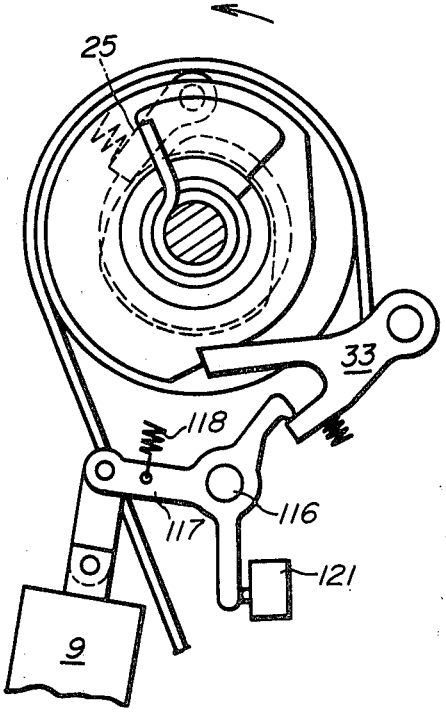
FIGS. 15–16 are side elevational views of the parts of FIG. 14.
Figure 16:
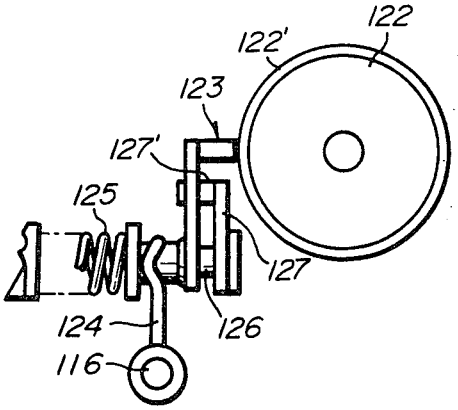

FIGS. 14–22 show a second embodiment of this invention. In FIGS. 14–16, the reference numeral 122 indicates a cam which is rotated by a gear 104 coaxially secured to the belt wheel 23. A cam follower 123 engages a cam face 122' formed on one side of the cam 122.

Figure 19:
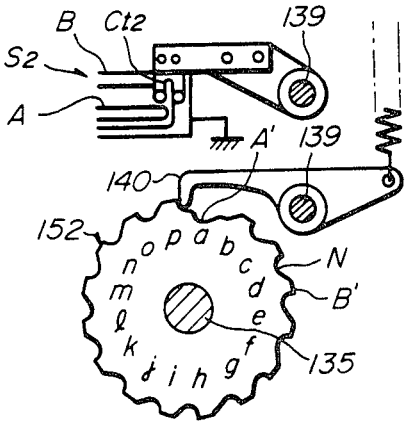
FIG. 19 is a detailed switching cam for pattern selecting cams.

FIG. 16 is a side elevational view seen along the arrow IV in FIG. 19, and shows conditions in which the solenoid 9 is deenergized. In this condition, the drive shaft 116 is rotated, and a lever 124 fixed thereto is turned counterclockwise against compression spring 125 to hold the cam follower 123, (which is axially movable on a support shaft 126) at a position where the follower is disengaged from the cam face 122' of the cam 122. At the same time, the solenoid 9 renders the stopper 33 inoperative so that the motor 5 may be connected to the main shaft 24 via the clutch pawl 25, as will be understood from FIG. 15. When the solenoid 9 is energized, the follower 123 is released and engages the cam face 122' of the cam 122.

The reference numeral 127 indicates a swing link which is secured to a swing shaft 126. The swing link 127 has a lateral pin 127' which engages the follower 123 in such a manner that the follower 123 can be displaced on the shaft 126 relative to the pin 127' as shown in FIG. 16. The swing link 127 is biased counterclockwise by a spring 128. A pawl member 129 is, at one end, pivotally mounted on the swing link 127. Therefore, when the belt wheel is rotated by the machine motor, the cam 122 is rotated to reciprocate the pawl member 129. Since the swing shaft 126 is swung, the swing links 127A and 127B as shown at B and C in FIG. 14, (which are all secured to the common swing shaft 126) are swung and therefore pawl members 129' and 129'', (which are respectively associated with swing links 127A and 127B) are longitudinally reciprocated.

Numeral 130 denotes a stopper for limiting the movement of swing link 127. 131, 132, and 133 denote solenoids which are energized and deenergized to selectively and respectively shift pawls 129, 129', and 129'' between an effective position and an ineffective position. In the effective position, a pawl member 129, 129', and 129'' can engage a respective one of the cam rotating ratchets 141, 142, and 143 to intermittently rotate them, and in the ineffective position the pawl members are spaced from the ratchets. These cam rotating ratchets are, respectively, rotatably mounted on support shafts 134, 135, and 136. 137 indicates an operating link for adjusting the cloth feeding mechanism (not shown). When the solenoid is energized, the operating link adjusts the feeding mechanism to feed the sewn material in reverse. 138 indicates a switch for opening and closing a switch of the machine motor controller and is operated when solenoid 133 is energized.

Figure 17:
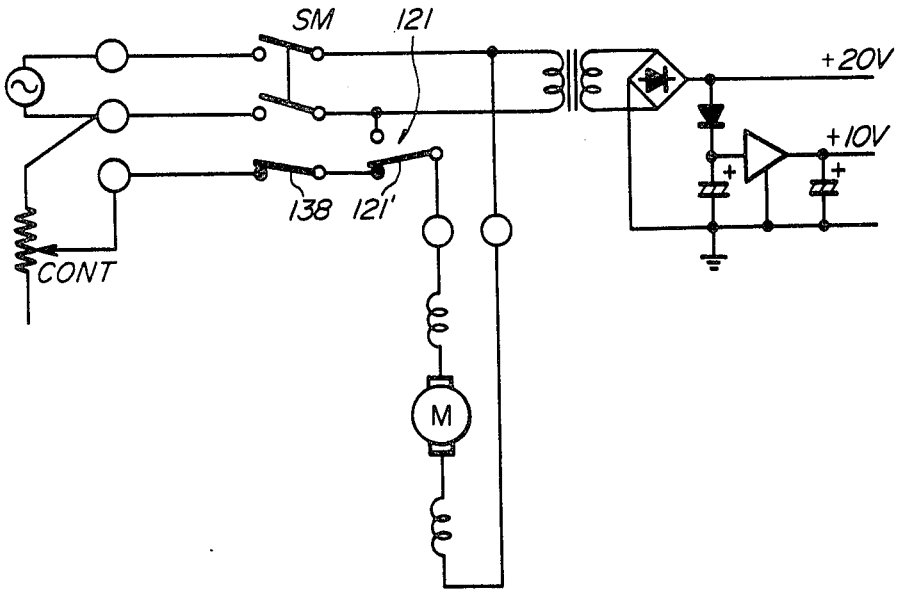
FIG. 17 is a circuit for driving the machine motor including a power source circuit for controlling the sewing machine.

FIG. 17 shows a motor driving circuit and a power source circuit for controlling the operation of the motor, in which SM indicates a power switch provided at the outer side of the sewing machine. M indicates a machine motor. CONT indicates a controller. 121 denotes a switch for the motor, and its contact 121' is positioned at the side of the controller CONT when the clutch solenoid 9 in FIG. 15 is not energized and is positioned at the side of the electric source when solenoid is energized. The switch 138 operates to cut the controller circuit off from the machine motor M when the solenoid 133 is energized. +10 V, +20 V are DC supplies for the control source and the solenoid driving source as is shown in FIG. 18.

FIG. 18 shows a control circuit, in which Sa to So indicate pattern selecting switches provided on the outer side of the sewing machine, each corresponding to the stitch patterns sewn by the sewing machine, and each being normally opened. The switches Sg and So serve, respectively, for selecting a first half step of a buttonhole composed of a first bar tack stitch and a left side line tack stitch, and a second half step of the buttonhole composed of a second bar tack stitch and a right side line tack stitch. The marks h and p (which are exluded from the switch indications) are, as will be described herein, made to correspond to the left line tack stitch and the right line tack stitches which are mechanically selected without operating the selecting switches. L indicates a latch circuit, having input terminals P1–P4 which receive inputs from the switches Sa to So, which inputs are encoded by NAND gates NA1 to NA4. When any one of the switches is operated, a transistor Trs becomes conductive to connect the input side of an inverter IN1 and to deliver a pulse to the trigger terminal Cp to latch the encoded data, so that the latch circuit L continues to issue signals from the respective outputs Q1 to Q4. C indicates a counter. The exclusive OR gates EX OR1 to EX OR4 are discriminators which discriminate whether or not the sinals Q'1 to Q'4 of the counter C are in accord with the output signals Q1 to Q4 of the latch circuit L. The output of EX OR1 is connected to NAND gate NA6 via NAND gate NA5, and the outputs of EX OR2 to EX OR4 are connected to NAND gate NA6 via NOR gate NOR1. NAND gate NA7 and NA8 constitute a reset flip-flop circuit, and NA7 receives power from source +10 V via a delay circuit composed of the resistor $R_1$ and condenser $C_1$. When the power source +10 V is connected before the pattern selecting switches Sa-So are operated, the input of the NAND gate NA8 becomes high via the inverter IN2, and the output of the NAND gate NA7 becomes high while the output of the NAND gate NA8 is low. The output of NAND gate NA8 is connected to AND gates $AND_0$ and $AND_3$ for selectively energizing the solenoids 9, 131, 132, and 133. The outputs of NAND gate NA7 and AND gate AND3 are connected to OR gate OR3 to energize the solenoid 131, to open the controller switch 138 so as to isolate the rotation of the motor M from the operation of controller CONT. Tr0 to Tr3 denote solenoids for, respectively, switching solenoids 9, 131, 132, and 133. $D_1$ to $D_1$ denote protective diodes for these solenoids. Va is a varistor for peaking the response of these solenoids when they are deenergized, by absorbing reverse EMF. The output of NAND gate NA8 is connected to the input of NA 10 of a reset flip-flop circuit that is composed of NAND gates NA9, NA 10. The input of the NAND gate NA9 is connected to the power source +10 V, and the output of NA9, which goes low when the power source +10 V is switched on, is connected to the input of NAND gate NA6. Since the NAND gate NA8 is under the control of transistor Trs, the input of the NAND gate NA8 becomes low when any one of the pattern selecting switches Sa-So is operated, and the flip-flop circuit of the NAND gates NA7 and NA8 is inverted. At this time, a flip-flop circuit composed of NAND gates NA9 and NA 10 is not inverted (as will be mentioned hereinafter). AND gate AND 0 receives the output of NAND gate NA6 via OR gates OR4, OR5, and OR1, and a low output at NAND gate NA9 energizes the clutch solenoid 9, independently of the status of the exclusive OR gates EX OR1 to EX OR4. Energization of the solenoid 9 operates the motor switch 121 to drive the motor M, independently of the controller CONT. At the same time, the stopper 33 shown in FIG. 15 is moved to its effective position to disconnect the main shaft 24 of the sewing machine from the belt wheel 104 and to rotate the cam 122 at a low speed. 151, 152 and 153 indicate switching cams for the selecting cams, the releasing cams and the automatic-manual switching cams. Cams 151, 152 and 153 are rotatably mounted on respective support shafts 134, 135, and 136 and are respectively, intermittently rotated by pawl wheels 141, 142, and 143 when the solenoids 131, 132 and 133 are selectively energized as shown in FIG. 14.

Figure 20:
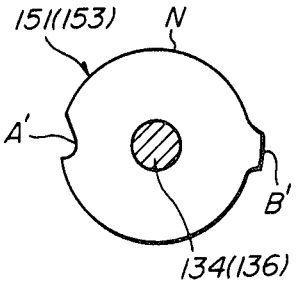
FIG. 20 is a detailed view of a switching cam for a releasing cam and an automatic-manual switching cam.
Figure 21:
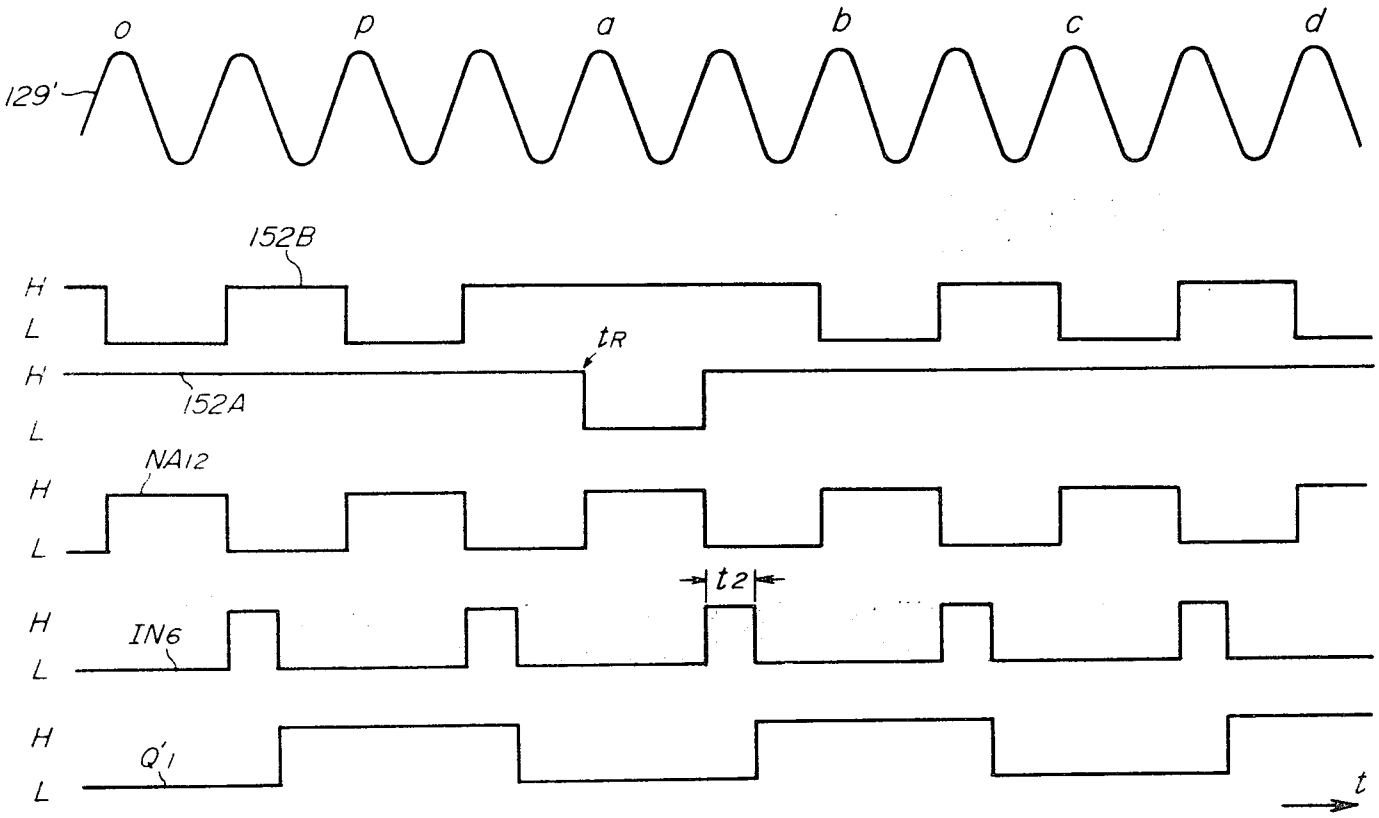
FIG. 21 are graphs of signals in the control circuit.

The switch cam 152 for the selecting cams has, as shown in FIG. 19, a recess A', corresponding to the basic zigzag stitches a in the patterns to be selected, and like projections B', each corresponding to the stitches b to p. These projections are divided in a like fashion. The portions not corresponding to the patterns a–p are defined by intermediate recesses N. A follower pawl 140, which is secured to a swing shaft 139, engages the switch cam 152. The follower 140 engages each of the patterns a–p during two steps of rotation of the switch cam 152 which are effected by the cooperation of the ratchet 142 and the pawl member 129'. The motion of the follower 140 is transmitted to a contact ct2 of switch $S_2$ through shaft 139. When the follower 140 engages recess A', the contact A is grounded. When the follower engages any one of the projections B', a contact B is grounded. When the follower engages any one of the intermediate recesses N, contacts A, B are not grounded. The switching cams 151, and 153 for the releasing cams and for the automatic-manual switching cams are each, as is shown in FIG. 20, formed with a recess A' and a projection B' opposed 180° to the recess, and are further formed with intermediate parts N as shown. Each of these switch cams 151, and 153 cooperate with switches $S_1$, and $S_3$ which are identical to switch S2. The contact B of switch $S_1$ operated by the switching cam 151 is connected to one of the inputs of an AND gate AND4, the other input being connected to the output of OR gate OR5. The output of the AND gate AND4 is connected to the input of OR gate $OR_2$, the output of which is connected in turn to the input of AND gate AND1. The contact B is connected to the power source +10 V. As is shown in FIG. 18, when the contact element $Ct_1$ is in an intermediate position the releasing solenoid 31 is energized, so that OR gate OR4 and NAND gate NA8 are both high to drive the ratchet 141, when the contact element $Ct_1$ of the switch $S_1$ contacts the contact B. In other words, contact B is grounded to stop the ratchet 141. The contact A of switch $S_1$ is connected to the power source +10 V and is connected to NAND gate NA11 via inventer IN3, and the output of NAND gate NA11 is connected to the input of NAND gate NA 5. In this case the contact A has no bearing on the high condition of OR gate OR4. The pawl wheel 141 is associated with the releasing cams, which are coaxially mounted on support shaft 134. When contact B of switch $S_1$ is grounded, the ratchet 141 drives the releasing cams to cause the pattern selecting cams (which are mounted on the shaft 135 coaxially with the ratchet 142) to select the pattern generating cams (or a pattern generating signal carrier). Further, since contact B of switch $S_1$ is connected to AND gates AND2 and AND3 via inverter IN4, it energizes the cam selecting solenoid 132 to drive the pawl wheel 142. The contact A of switch $S_2$ receives power from the source +10 V and is connected to an input of NAND gate NA9. When contact A is opened, the high state of NAND gate NA8 does not invert NAND gate NA9, if the latter has previously gone low. However, when the contact $Ct_2$ reaches contact A it inverts the output of NAND gate NA9 to bring that output high. Then, NAND gate NA6 operates discriminators EX OR1 to EX OR4. Further, contact A of switch $S_2$ is connected to the reset terminal R of the counter C via inverter IN5. Therefore, when contact A is grounded, the falling signal at the terminal R resets the counter C to make the output signals Q'4, Q'3, Q'2 and Q'1 equal to 0000. Subsequently, when contact A is opened, the reset of the counter C is released. Contact B of switch $S_2$ receives power from the source +10 V, and contacts A, B of switch $S_2$ are connected to the inputs of NAND gate NA 12, the output of which is connected to the trigger terminal Cp of the counter C via a monostable multivibrator composed of a resistor $R_2$, a capacitor $C_2$, and an inverter IN6. Therefore, the output of NAND gate NA 12 is made low by the rising signal generated when either of contacts A or B is opened, and the falling signal at the inverter IN6 during a predetermined time interval causes the counter C to count up. The counting up is performed during the increasing pulse width of inverter IN6, which pulse width is narrower than the width of a low state of NAND gate NA 12 as shown in FIG. 21, before the next pattern (b for example) becomes effective. When, for example, pattern selecting switch $S_2$ is operated, the outputs $Q_4$, $Q_3$, $Q_2$ and $Q_1$ of the latch circuit L are equal to 0000, and counter C brings NAND gate NA6 low without counting up after the resetting. The counter C is, as mentioned, counted up each time contact A or contact B of switch $S_2$ is opened, until the counter C reaches that code of the latch circuit L which corresponds to a selected pattern. When the pattern selecting cams are rotated and the selection of a pattern generating cam or cams has been made in response to any one of the pattern selecting switches Sa to So, NAND gate NA6 goes low. The output of NAND gate NA 12 is connected to an input of NOR gate NOR2, the output of which is connected to one of the inputs of OR gate OR4. The output of NAND gate NA6 is connected to another input of NOR gate NOR2 via the monostable multivibrator composed of the inverter IN7, resistor R3, and capacitor C3.

During the low state of the NAND gate NA12 after the counting up has ceased, capacitor $C_3$ is charged. While the capacitor $C_3$ is charging, it stops the ratchet 142 for a while. When the capacitor has been charged up, it rotates the ratchet 142 again until the NAND gate NA12 becomes high. At the subsequent stop position of the ratchet 142, the pattern generating cams are selected. Hence, the selected pattern generating cam or cams are engaged by corresponding cam follower or followers. The output of OR gate OR5 is connected to one of the inputs of AND gate AND5 via inverter IN8, and the other input of AND gate AND5 is connected to contact A in association with the switching cam 151, and the output of gate AND5 is connected to the input of OR gate OR1 and is also connected to the input of OR gate OR2 via a delay circuit composed of resistor R4 and capacitor $C_4$. When OR gate OR4 is low, and contact A of switch $S_1$ is opened, the output of AND gate AND5 becomes high and the low status of OR gate OR2 is maintained while the capacitor $C_4$ charges. Thus, when NAND gate NA12 is high due to the stationary condition of the selecting cams, (which, in association with switch cam 152, are at a predetermined angular position) the solenoid 131 is energized to rotate the pawl wheel 141, to cause the releasing cams to render the pattern generating cams effective by engaging the cam followers with the pattern operating cams. OR gate OR4 is high until NAND gate NA12 goes high after re-rotation of the pawl wheel 142, but during the delay time caused by the delay circuit which includes the capacitor $C_4$ the pawl wheel 141 does not operate. Solenoid 131 is energized to rotate the pawl wheel 141 during predetermined time interval, and contact B of switch $S_1$ is opened but AND circuit AND1 is high. When contact A is grounded, AND gate AND5 is lowered and the capacitor $C_4$ discharges through diode $D_2$, and solenoid 131 is then deenergized to stop the pawl wheel 141. In this stopped position, the releasing cams cause the pattern generating cams to be operated.

A further reference will be made to driving of the pawl wheel 143 for the automatic-manual switching cams. A contact MAN of the manual side of AUTO-MANUAL switch $S_4$, provided on the outside of the sewing machine, is connected to contact A of switch $S_3$ which is operated by switch cam 153, and contact AUTO of the automatic side is connected to contact B. Contact element $Ct_4$ of switch $S_4$ receives power from the source +10 V and is connected to the inputs of AND gate AND3 and OR gate OR5. When contact $Ct_3$ is in the intermediate position as shown in FIG. 18, the solenoid 9 is energized via AND gate AND0, and solenoid 133 is energized via AND gate AND3 so that contact B of switch $S_2$ is not grounded. When contact $Ct_4$ is grounded, the switching cam 153 is stopped to switch to the automatic or manual setting of the sewing machine depending on the switched position of the automatic-manual setting switch $S_4$. Thus, the feeding amount and the needle swinging amplitude of the sewing machine, for example, can be automatically or manually adjusted in accordance with the selected pattern cam.

An explanation will be given for back stitching to generate checking stitches on termination of stitching. A normally opened switch $S_5$ on the outside of the sewing machine is ineffective if it is operated during the selection of the pattern generating cams. The output of AND gate AND0 is grounded via a delay circuit composed of the resistor $R_5$, capacitor $C_5$, inverter IN9, and switch $S_5$, and the grounded side of switch $S_5$ is connected to the input of OR gate OR2. The switch $S_5$ energizes the solenoid 131 to move a link 137 in FIG. 14 upwardly and to operate the feed changing mechanism (not shown). However, when AND gate AND0 is high during the energization of the solenoid 9, inverter IN9 becomes instantly low via diode $D_3$ and nullifies the operation of switch $S_5$. After AND gate AND 0 becomes low, condenser $C_5$ is not instantly discharged and therefore, during certain time interval, the input of OR gate OR2 raised and solenoid 131 is then energized. Since the capacitor $C_5$ is charged during the stitching operation of the sewing machine, actuation of switch $S_5$ instantly generates back or checking stitches.

Button hole stitching will now be discussed. Switching from the bar tack stitches to the line tack stitches of the first half of a buttonhole is mechanically carried out after a predetermined number of bar tack stitches have been made. At this changeover of the stitches the switching cam 152 is rotated to open or close the contact B of the switch $S_2$ so that the counter C advances one count. As a result, the lower three bits of outputs $Q'_3$, $Q'_2$ and $Q'_1$ of counter C are 1 1 1. The, contact A of switch $S_1$ is grounded, via the inverter $IN_3$, (while the pattern generating cams have been selected) and renders both NAND gate NA11 and OR gate $OR_4$ low. For this purpose, the operation of the buttonhole selecting switches Sg, So sets the code at 1 1 0.

In this case, when the power source switch SM in FIG. 23 is closed, the control power source +10 V and the solenoid driving power source +20 V become effective. Referring to FIG. 18, the inverter IN2 then goes high, NAND gate NA7 goes high and NAND gate NA9 goes low. NAND gate NA7 energizes AUTO-MANUAL switching solenoid 133 only to open the controller switch 138 and isolate the circuit of the controller CONT from the motor M. When, for example, switch Sc of the pattern selecting switches Sa to So is operated, the code 0 0 1 0 corresponding to the switch Sc is latched at the output sides $Q_4$ to $Q_1$ of the latch circuit L, NAND gate NA7 simultaneously goes low. (NAND gate NA8 is high already.) NAND gate NA9 going low makes the output of OR gate OR4 high, and clutch solenoid 9 is energized to actuate the motor switch 121 to drive the motor M, independently of controller CONT. As a result, the stopper 33 shown in FIG. 15 is moved to its effective position to separate the main shaft 100 from rotating belt wheel 104. The solenoid 9 turns the lever 124 shown in FIG. 16 clockwise to engage the follower 123 with the cam 122. As a result, the driving pawls 129, 129' and 129'' are reciprocated. When the contact $Ct_1$ of switch $S_1$ is in its intermediate position as shown in FIG. 18, NAND gate NA4 is made high to energize releasing solenoid 131 and drive the ratchet 141. When the contact $Ct_1$ is shifted, contact B becomes low to stop the ratchet 141. Thus, the selection of the pattern cam is possible. A low at contact B of contact $Ct_1$ energizes the cam selecting solenoid 132 via inverter IN4 to drive the ratchet 142. When the contact $Ct_2$ of switch $S_2$ reaches the contact A to lower it, the NAND gate NA9 is inverted to high, and NAND gate NA6 renders the discriminators EX OR1 to EX OR4 effective. Concurrently, the counter C is reset to make outputs $Q'_4$, $Q'_3$, $Q'_2$ and $Q'_1$ 0 0 0 0.

Subsequent operations will be discussed in reference to FIG. 21. A lateral axis t indicates a time in which the belt wheel is rotated with a predetermined speed. 129' shows the operation of the cam selecting drive pawl. The rising portions of a curve are intervals for rotating the ratchet 142, and the falling portions are stopping intervals of the ratchet 142 while the driving pawl 129' returns downwardly. The rising portions in the two stepwise rotations of the ratchet 142 correspond to the setting portions a to p of the pattern enerating cams. 52A, 52B are contacts of the switch $S_2$. H and L show the logical levels of signals. The reset of counter C is carried out at falling time $t_R$ where the contact 152A becomes low. At this time, the output of latch circuit L and the output of the counter C are not congruant. Therefore, OR gate OR4 stays high, the pawl wheel 142 continues to rotate and the contact $Ct_2$ opens contact A. Afterward, contact B is repeatedly opened and closed. Each time the contact B is opened, inverter IN6 issues a pluse of width $t_2$ under the influence of the resistor $R_2$ and condenser $C_2$, and counter C is counted up while the pulse falls. In this case, with two counts, the outputs $Q'_4$, $Q'_3$, $Q'_2$ and $Q'_1$ become 0 0 1 0 to make NAND gate NA6 low, and NAND gate NA12 deenergizes solenoid 132 during the charging time of the capacitor $C_3$ in the lower period of the gate NA12 after the second count. Thus, the ratchet 142 is stopped until it is rotated again by reenergization of the solenoid 132. The ratchet 142 is stopped when the OR gate $OR_4$ becomes low on the rising pulse of the NAND gate NA12. This stopped position of the ratchet 142 corresponds to that condition in which the pattern cams are ready to be selectively engaged by the corresponding followers. The rise time of NAND gate NA12 is slightly ahead of the rise of the curve 129' where the stepwise rotation of the ratchet 142 for the pattern C is finished, and it stops the driving pawl 129' precisely during the subsequent rest period of the ratchet. Since the contact $Ct_1$ of the switch $S_1$ is on contact B, a low at OR gate OR4 energizes the releasing solenoid 131 to rotate the ratchet 141 after the delay time caused by resistor $R_4$ and the condenser $C_4$, after the pattern cams have been stopped in their predetermined angular positions. The pawl wheel 141 is stopped when the contact $Ct_1$ is at contact A, solenoid 116 is deenergized, and the controller CONT begins to operate. At this time, the releasing cams engage the followers with the pattern cams selected for the pattern C, and the selection of the pattern cams is completed.

The operation of the control circuit for forming the second half of the buttonhole will now be discussed. When the pattern selecting switch $S_0$ is operated, the outputs $Q_4$, $Q_3$, $Q_2$ and $Q_1$ of the latch circuit L are made 1 1 1 0, and the counter C counts 14 counts for selecting the corresponding pattern cam for bar tack stitches. When a predetermined number of bar tack stitches have been stitched, the right side line tack stitches are formed with an automatic mechanical adjustment without the operation of solenoids 9, 131, 132 and 133. This mechanical adjustment for the line tack stitches causes the switch cam 152 to make the pattern 9, so as to make the counter C count one step up. Thus the outputs $Q'_4$, $Q'_3$, $Q'_2$ and $Q'_1$ are made 1 1 1 1. Therefore the exclusive OR gate EX OR1 is made high but since contact A of switch $S_1$ is low, NAND gate NA11 becomes low and NAND gate NA5 becomes high and OR gate OR4 becomes low. Therefore, the buttonhole stitching is performed without driving solenoids 9, 131, 132 and 133.

FIG. 22A shows a third embodiment of this invention which employs a microprocessor instead of the controlling circuit in FIG. 18. TMS 1000 is here a 4-bit microprocessor made by Texas Instruments Inc., and sold as Model No. TMS-1000. The pattern selecting switches Sa to So are connected as shown, and receive storage signals issued from terminals $R_0$ to $R_5$. The outputs of the switches Sa to So are connected to the terminals $K_1$, $K_2$, $K_4$, and $K_8$ of the microprocessor TMS 1000 via OR gate $OR_6$ to $OR_8$ or directly. OR9 and OR10 indicate OR gates. INIT indicates a reset terminal which resets the microprocessor TMS 1000 when the control power source +10 V is energized. $C_6$ and $R_6$ indicate a capacitor and a resistor which are components of a clock pulse generator provided for clocking the microprocessor. La to Lo are indicating lamps each responsive to operation of the pattern selecting switches. The microprocessor TMS 1000 is so programmed as to perform the same controls as in the control circuit in FIG. 24 and is operated in the same manner as has been described in reference to FIG. 18.

Figure 25:
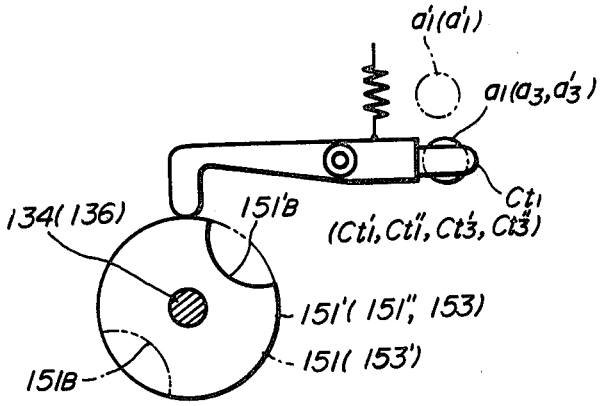
FIG. 25 is a detailed view of a switching cam for a releasing cam and an automatic manual switching cam, and a switch relative thereto.
Figure 26:
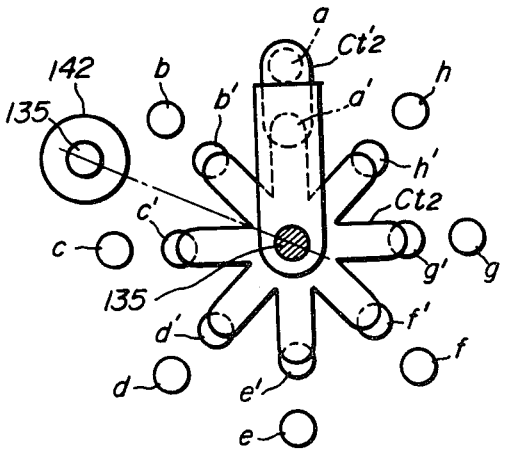
FIG. 26 is a detailed view of a switch for selecting cams and switchs relative thereto.
Figure 27:
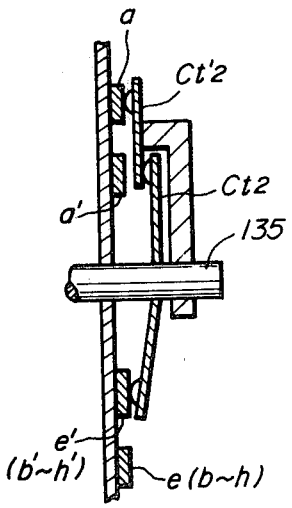
FIG. 27 is a cross section taken along line VII—VII of FIG. 23.

FIG. 24 is a control circuit showing a fourth embodiment of this invention where V is an AC power source. SM indicates a power source switch provided on the outer side of the sewing machine. M indicates a machine motor. CONT indicates a controller. 221 indicates a motor switch whose contact 221' is at the side of the controller CONT when the clutch solenoid 9 is not energized. The contact 221' is shifted to the side of the power source when the solenoid 9 is energized. SR indicates a full-wave rectifying circuit whose positive side is connected to ends of solenoids 9, 131, 132 and 133, and whose negative side is connected to cathodes of thyristors $SCR_A$ *to* $SCR_H$ *of circuit* groups $C_A$ to $C_H$ (enclosed within double-dotted lines) which are in parallel and other (per available patterns A to H) and which connected to these solenoids. The negative side of the full-wave rectifying circuit SR is also connected to the cathodes of a plurality of diodes $D_1$ to $D_1$ which are connected in series with solenoids 9, 131, 132 and 133 to power the solenoids independently of the thyristors after the selection of the patterns has been completed. The group of diodes $D_1$ to $D_1$ has a forward voltage drop greater than that of each of the thyristors $SCR_A$ to $SCR_H$. Therefore, when these thyristors conduct through solenoids 216, 231, 232 and 233, electric current flows in the thyristors prior to flowing in diodes D tl $D_1$. $D_2$ to $D_2$ *denote* protective diodes for diodes $D_1$ to $D_1$, and Va is a varistor which absorbs energy generated when the solenoids are deenergized, to peak response by absorbing reverse EMF. With respect to the switches $S_1$, $S'_1$, $S''_1$, contact $Ct_1$ of switch $S_1$ is connected to the other end of solenoid 9 via diode $D_3$ and to the other end of solenoid 131 via diode $D_4$ and switches 138 and 139. The contact elements $Ct'_1$ and $Ct''_1$ of switches S1 and $S'_1$ are, respectively, connected to the other ends of solenoids 132 and 133. The switch cams 151, 151' and 151'' are normally in the angular positions shown, and the contacts $a_1$, $a'_1$ and $a''_1$ of the respective switch cams are opened. The contact $Ct_1$ is connected to a contact $a'_1$ of a switch $S'_1$ via the diode $D_5$. In FIGS. 23 and 25, the switching cam 151 and switch cams 151' and 151'' have respective recesses 251B and 251'B opposed by 180° and are rotated on the common shaft 134 by the ratchet 141 for the releasing cams. Therefore, the ratchet 141 is driven by energization of the solenoids 9 and 131, as mentioned above. The angular positions of these switching cams 151, 151' and 151'' in FIG. 24 show that the releasing cams (not shown) keep the followers engaged with the pattern cams selected. These followers are released from the cams when the switching cams have been rotated 180°. Contact $a_1$ is connected to the anode sides of the diodes $D_1$ to $D_1$. The switches $S_2A$ to $S_2H$ have contacts $Ct_A$ to $Ct_H$ connected to the contact $a'_1$ of a switch $S'_1$. The structure of the switches is, as shown in FIGS. 26 and 27, such that the contacts $Ct_2$ and the terminals a' to h' are commonly closed and connected to the terminal $a'_1$ in FIG. 24. When the contacts $Ct'_2$ rotated around the shaft 135 contacts a specific contact, (e.g. a of contacts a to h), a corresponding contact a' of contacts a' to h' is opened, and the contact $Ct'_2$ is connected to the contact $Ct_2$. The group of contacts $Ct_2$, $Ct'_2$ corresponds to the contact elements $Ct_A$ to $Ct_H$ in FIG. 24. Then, any one of the contacts a to h of the gate sides of the thyristors $SCR_A$ to $SCR_H$ (corresponding to the patterns A to H) is selectively connected to contact $a'_1$ and opens the others. The opened condition of the other contact elements closes the contacts a' to h' of the anode sides of the thyristors $SCR_A$ to $SCR_H$. The contact element $C't_2$ is rotated by the ratchet 142 and the resultant operation of the switches depends upon the energization of the solenoids 9 and 132. When the contact elements $Ct_A$ to $Ct_H$ of the contacts a to h are closed, the pattern A, for example, is selected, and the follower is ready to engage the pattern cam selected. $S_A$ to $S_H$ indicate pattern selecting switches to be operated on the outer side of the sewing machine. $R_1$, $R_{A1}$ to $R_{H1}$ and $R_{A2}$ denote electric current limiting resistors for the gate sides of the thyristors $SCR_A$ to $SCR_H$. $LED_A$ to $LED_H$ indicate light-emitting diodes selectively lighted by the conduction of the respective thyristors to indicate the selected patterns A to H. $R_2$ and $R_{A3}$ to $R_{H3}$ show protective resistors for the light-emitting diodes. $D_{A1}$ to $D_{H2}$, $D_{A2}$ to $D_{H2}$ denote diodes. $R_3$ and C indicate a resistor and a condenser for preventing the thyristors $SCR_A$ to $SCR_H$ from accidental firing. The contacts $Ct_3$, $Ct'_3$ of switches $S_3$, $S'_3$ are connected to the contact $Ct_1$ of switch $S_1$ via the contact $a''_1$ of the switch $S''_1$ and the diode $D_6$. The contact $a_3$ of a switch $S_3$ is connected to the automatic side contact AUTO of AUTO-MANUAL setting switch $S_4$ which is to be operated on the outer side of the sewing machine, and the contact $a'_3$ of a switch $S'_3$ is connected to the manual side contact MAN of the AUTO-MANUAL setting switch. The switching cams 153 and 153' rotated with the AUTO-MANUAL setting switch ratchet 143 on the shaft 236 have different recesses 151B, and 151B' opposed by 180° as shown in FIG. 25. As shown in FIG. 24, the contact $Ct_3$ is opened if the contact $Ct_4$ of switch $S_4$, connected to the diodes $D_1$ to $D_1$, is on the AUTO side, and is closed if the contact element $Ct_4$ is on the MANUAL side. Furthermore, the contact element $Ct'_3$ is closed if the contact element $Ct_4$ is on the side of AUTO side, and is opened if the element $Ct_4$ is on the MANUAL side of the Automatic-Manual setting switch $S_4$. The rotation of these switching cams 153 and 153' is controlled by energization of solenoids 9 and 133. When the AUTO-MANUAL switching cam (not shown) is rotated 180°, contact element $Ct_4$ is shifted to the MANUAL side. $S_5$ indicates a switch to be operated on the outer side of the sewing machine. Switch $S_5$ is for the checking stitches on the termination of stitching and is normally opened. The switch S5 opens and closes between solenoid 131 and the diodes $D_1$ to $D_1$. While the switch is pressed, the checking stitches are sewn.

FIG. 33 shows that the pattern A has been selected. When the electric source switch SM is closed, the thyristor $SCR_A$ of the thyristors $SCR_A$ to $SCR_H$ forms the gate circuit, but the anode circuit is opened, and the respective solenoids 9, 131, 132 and 133 do not form main circuits via respective solenoids or diodes $D_1$ to $D_1$, and the respective switches are maintained as shown, (where the pattern A is selected) and the switch 121 turns the controller CONT on. Therefore, when the controller is operated, the sewing machine is operated to sew stitches. The light-emitting diode $LED_A$ is lighted by the full wave rectifying current via the thyristor $SCR_A$ to indicate the pattern A.

When a pattern selecting switch $S_B$ is pushed to select a pattern B, the thyristor $SCR_B$ is ignited to cut off the gate current of the thyristor $SCR_A$ and to turn off the light-emitting diodes $LED_A$, and to turn on the light-emitting diode $LED_B$. Solenoids 9 and 131 are energized and the conduction of the thyristor is maintained by their inductance. The clutch solenoid 9 causes the switch 121 to drive the motor M, independently of the controller CONT. At the same time, the stopper 33 shown in FIG. 15 is operated to separate the main shaft 200 from being driven by the belt wheel, in order to rotate the belt wheel relative to the main shaft.

At the same time, solenoid 9 turns the lever 124 in FIG. 16 clockwise, and allows the cam follower 123 to engage the cam 222. The pawls 129, 129' and 129'' in FIG. 23 are longitudinally reciprocated. The releasing solenoid 131 engages the pawl member 129 with the ratchet 141 to rotate the ratchet 141. When switching cams 151, 151' and 151'' rotate 180°, the releasing cams (not shown) move to their releasing positions to accomplish the pattern selection, and contact $Ct'_1$ simultaneously contacts the contact $a'_1$ to energize the selecting solenoid 132, whereby the switch 238 is opened and the ratchet 141 stops. Solenoid 132 drives the ratchet 142 and contact $Ct_A$ of the switch $S_{2A}$ closes the contact a'. Then the contact $Ct_B$ of the switch $S_{2B}$ is moved to contact b from contact b', and solenoid 132 is deenergized to stop the movement. At the switch-over of these contacts, the gate of thyristor $SCR_B$ is turned on to light up the light-emitting diode $LED_B$. The pattern selecting cams (not shown) have already been rotated to come into a pattern selecting relation with the pattern cams. When the solenoid 132 is deenergized, the switch 238 is again opened, and solenoid 131 is energized via switch $S_1$ and the diodes $D_1$ to $D_1$, and switching cams 151, 151' and 151'' are further rotated 180° to the position shown in FIG. 24. Then, switch $S_1$ is opened to deenergize solenoids 9 and 131, in order to stop the switching cams 251, 251' and 252'', and the releasing cams (not shown) set the pattern cams (not shown) for stitching, and the switch 121 is operated to enable the controller CONT to finish the pattern selection.

When the contact $Ct_4$ of AUTO-MANUAL setting switch $S_4$ is switched to contact MAN from the condition shown in FIG. 24, solenoids 9, 131 are energized, and the switching cams 151, 151', 151'' are rotated 180° to close the switches $S_1$, $S'_1$ and $S''_1$. Then the solenoid 133 is energized via the switches $S''_1$, $S'_3$ and $S_4$ and the diodes $D_1$ to $D_1$, and the switch 239 deenergizes the solenoid 131 and rotates the switching cams 153, 153' 180° to open the switch $S'_3$, in order to deenergize solenoid 133. At the same time the solenoid 131 is energized, to rotate the switching cams 151, 151' and 151'' to the positions shown in FIG. 24. Thus the sewing machine is ready to be manually set in accordance with the selected pattern.

I claim:

1. An automatic sewing machine comprising a machine housing; a main shaft rotatably mounted in the machine housing to vertically reciprocate a needle bar with a needle; a belt wheel mounted on the main shaft and rotatable relative to the main shaft; drive means for rotating the belt wheel; clutch means arranged between the main shaft and the belt wheel and normally connecting the main shaft to the belt wheel so that the main shaft may be rotated together with the belt wheel; pattern information carrying means including a stack of individual pattern cams and rotated in a reduced speed by the main shaft; pattern cam selecting cam means rotatable stepwise to select the pattern cams; drive cam means operatively connected to the belt wheel and rotated thereby; follower means engaging the drive cam means and swingable thereby; transmission means connected to the follower means and reciprocated thereby; switch cam means opposed to the pattern cam selecting cam means and connected to the transmission means in such a manner as to be rotated stepwise thereby; means transmitting the stepwise rotation of the switch cam means to the pattern cam selecting cam means to rotate the pattern cam selecting cam stepwise; follower means arranged opposite to the cam selecting cam means and selectively operated thereby to engage the pattern cams; and pattern selecting means including individual pattern-selecting switches arranged on the machine housing and manually operable to select one of the pattern cams.

2. An automatic sewing machine as defined by claim 1, wherein the pattern cam selecting cam means includes a stack of individual cams, wherein the drive cam means is rotated by the belt wheel at a reduced speed, wherein the switch cam means includes a stack of switch cams, and wherein the follower means includes a plurality of followers.

3. An automatic sewing machine as defined in claim 2, further comprising an electric control circuit means operated by one of the pattern selecting switches; solenoid means operated by the electric control circuit means to cause the drive means to operate at a reduced speed and to simultaneously operate the clutch means to disconnect the main shaft from the belt wheel; switch means including individual switches each arranged opposite to the switch cams and cooperating therewith and selectively energized by the pattern selecting switches an energized one of the switches cooperating with a corresponding switch cam and cooperating with the electric control circuit to deenergize the solenoid so that the drive means may be stopped, and to simultaneously operate the clutch means so that the main shaft may be connected to the belt wheel when the corresponding pattern selecting cam selects a specific pattern cam.

4. An automatic sewing machine as defined in claim 2, further comprising means engaging the follower means with the drive cam, the means comprising solenoid means electrically operated by selectively operating one of the pattern selecting switches and linkage means connecting the follower means and the solenoid means.

5. An automatic sewing machine as defined in claim 2, further comprising means for automatically adjusting the lateral reciprocation amplitude of the needle bar in accordance with a selected pattern, the last-mentioned means comprising cam means including a stack of individual adjusting cams which are each angularly positioned by the drive cam means, a manually accessible automatic adjusting switch arranged on the machine housing, selecting cam means including a set of individual selecting cams arranged coaxially with the pattern selecting cams, a set of followers selectively brought into engagement with the corresponding adjusting cams by operation of the automatic adjusting cam means, a set of followers selectively brought into engagement with the corresponding adjusting cams upon engagement of the followers with the corresponding selecting cams, and a link member operatively connected at one end to the followers facing the adjusting cams and operatively connected at another end to the needle bar.

6. An automatic sewing machine comprising: a machine drive source; a plurality of pattern generating cams rotatably mounted in the sewing machine; cam followers, each cam follower being displaceable between an effective position engaged with the pattern generating cams and an ineffective position disengaged from the pattern generating cams; a pattern cam selecting device for selectively displacing the cam followers to their effective positions and including a first group of cams to disengage the cam followers from the pattern generating cams, and a second group of cams to engage the cam followers with the pattern generating cams, and first and second groups of cams' change-over switches, driving means to open and close in a predetermined sequence the cams' change-over switches when the second group of cams come to a position selecting position; pattern selecting switches each connected in series with the change-over switches; actuating means operative when connected to the machine drive source to automatically actuate the pattern cam selecting device; electromagnetic means connected in series with the pattern selecting and change-over switches, and energized to connect the actuating means to the machine drive source; an electric control circuit including circuit change-over switches and a semiconductor switching element and operated by manual operation of a selected one of the pattern selecting switches to first drive the follower disengaging cams to a follower engaging position, and then to still subsequently drive the follower disengaging cams to a position for releasing the cam followers, thereby terminating an automatic pattern selection cycle, further comprising additional cams driven with the follower disengaging cams and the pattern selecting cams and automatically determining a needle swinging amplitude and a feeding amount in accordance with a selected pattern, and additional followers operated by the follower disengaging cams to selectively engage and disengage the needle and feed adjusting cams, further comprising cams for manually determining needle swinging amplitude and feed amount, switching cams selectively rendering effective one of the automatic adjust setting cam group and the manual adjust setting cam group, means for driving the switching cams, rotary switches cooperating with the switching cams, and automatic-manual adjust setting switches for operating the control circuit to selectively render effective one of the automatic adjust setting cam group and the manual adjust setting cam group.

7. An automatic sewing machine comprising a machine housing; a main shaft rotatably mounted in the machine housing; a needle bar with a needle arranged in the housing for vertically reciprocating movement and being driven by the main shaft; a drive motor for rotating the main shaft; pattern information carrying means including a pack of individual pattern cams and rotated at a reduced speed by the main shaft; pattern cam selecting means rotated to select the pattern cams; drive means operatively connected to the drive motor to rotate the pattern cam selecting means; follower means arranged opposite to the cam selecting means and selectively operated by the latter to engage the pattern cams; pattern selecting switches arranged on the machine housing and manually operated to select one of the pattern cams; electric circuit means operatively connecting the pattern selecting switches to the drive motor and operated by a selective operation of the pattern selecting switches to activate the drive motor; transmission means selectively connecting the drive motor to the main shaft and to the drive means; and clutch means selectively operated by a selective manipulation of the pattern selecting switches to selectively connect the drive motor to the main shaft and to the drive means.

* * * * *